US006322076B1

(12) United States Patent
Fikki

(10) Patent No.: US 6,322,076 B1
(45) Date of Patent: Nov. 27, 2001

(54) INVESTMENT BOARD GAME AND METHOD OF PLAYING SAME

(76) Inventor: Steve E. Fikki, 4318 Saville Cir., Independence, MO (US) 64055

( * ) Notice: Subject to any disclaimer, the term of this patent is extended or adjusted under 35 U.S.C. 154(b) by 0 days.

(21) Appl. No.: 09/389,169

(22) Filed: Sep. 2, 1999

(51) Int. Cl.[7] ..... A63F 3/00
(52) U.S. Cl. ..... 273/278; 273/256
(58) Field of Search ..... 273/236, 242, 273/243, 244.2, 256, 278

(56) References Cited

U.S. PATENT DOCUMENTS 3,765,682 * 10/1973 Braude .
4,061,336 * 12/1977 Lincoln .
4,244,579 * 1/1981 Campos .
4,934,707 * 6/1990 Koster .
5,183,257 * 2/1993 Shore .
5,810,359 * 9/1998 Wilkins .
5,826,878 * 10/1998 Kiyosaki .
5,829,746 * 11/1998 Pacella .
5,829,747 * 11/1998 Nebel .
5,934,674 * 8/1999 Bukowsky .

OTHER PUBLICATIONS

3M Company Board Game entitled "Stocks & Bonds"; specifically copies of Front and Back Covers of Box, Stocks & Bonds Securities Review Sheet, Game Board, Record Keeping Sheet, Stocks & Bonds Bear and Bull Market Calculator, Stock Certificates, and Bull and Bear Game Cards (1964).

Herbko International, Inc. Board Game entitled "Stock Market The Wall Street Trading Game"; specifically copies of Front and Back Covers of Box, Instructions, Game Board, Record Keeping Sheet, Stocks & Bonds Bear and Bull Market Calculator, Stock Certificates, and Bull and Bear Game Cards (1997).

* cited by examiner

*Primary Examiner*—Benjamin H. Layno
*Assistant Examiner*—Vishu K Mendiratta
(74) *Attorney, Agent, or Firm*—Hovey, Williams, Timmons & Collins

(57) ABSTRACT

An investment board game and game method are disclosed. The board includes an endless path along which the players' game pieces are moved. The path includes a plurality of stock spaces, each representing a stock and a stock purchase price. Upon moving to one of the stock spaces, the player is permitted to purchase shares of stock for that space. If shares are purchased, the player must draw a stock value card which has the potential of changing the closing value of the stock. The stock value cards are preferably arranged into low, medium and high risk card sets, with the player being limited to selecting from one of the sets depending on the present value of the stock. A plurality of personal risk spaces are dispersed among the stock spaces along the path, and a player who moves to one of these spaces must draw a personal risk card that is likely to monetarily award or penalize the player. The board similarly includes a plurality of global risk spaces, and a player who moves to one of these spaces must draw a global risk card that has indicia representing a change in the purchase price and closing value for at least one stock. Spaced apart along the path are also a busted space and a confinement space, with the player who has landed on the busted space being required to move to the confinement space pay a penalty, and miss at least one turn.

25 Claims, 8 Drawing Sheets

INVESTMENT BOARD GAME AND METHOD OF PLAYING SAME

BACKGROUND OF THE INVENTION

1. Field of the Invention

The present invention relates generally to an investment game. More particularly, the present invention concerns the board and various other components used in playing the investment game. The present invention also particularly concerns an investment game methodology which is believed to realistically represent stock market investing and to provide investment education to the players.

2. Discussion of Prior Art

It is known to provide a board game and/or game method that simulates investment practices and situations in the stock market. However, conventional investment games simply are not realistic, and the players are consequently not given the impression that their participation accurately represents the activities normally associated with the stock market. Moreover, because of the unrealistic nature of conventional investment games, such expedients necessarily lack educational value. That is, traditional investment games are simply incapable of truly educating the game participants about the stock market. Conventional investment games are also often difficult to play, and there is typically a significant amount of time invested in simply understanding the peculiarities and tedious rules of the game.

OBJECTS AND SUMMARY OF THE INVENTION

Responsive to these and other problems, an important object of the present invention is to provide an investment board game and game methodology that overcomes the shortcomings of traditional investment games. Particularly, an important object of the present invention is to provide an investment board game and game methodology that realistically simulates investment situations and practices. Another important object of the present invention is to provide an investment board game and game methodology that is highly educational for the players. In this regard, an important object of the present invention is to not only educate the players about the stock market but also provide education on other issues. Another important object of the present invention is to provide a board game and game methodology that is relatively easy to understand and play, while still sufficiently challenging the players. That is, an important object of the present invention is to provide an investment board game and game methodology that is interesting yet readily understandable.

In accordance with these and other objects evident from the following description of the preferred embodiment, the present invention concerns an investment board game including a board having a plurality of stock spaces that define at least in part an endless path. Each of the stock spaces includes indicia identifying a stock, with each space further including a stock purchase price area in which a purchase price for the stock may be represented. A plurality of game pieces are provided to represent the players as they move along the path. The board game further includes mechanism for providing a random space count for controlling movement of the pieces along the path. A chance indicator is used to determine a closing value for the stock purchased by each of the players. The board game also includes a stock portfolio device operable to permit input and storage of the purchased stock and the closing value for the purchased stock.

The invention also concerns a method of playing an investment game, wherein players are provided with an initial amount of money. Each player is moved along a path that includes a plurality of stock spaces. As above, each stock space is associated with a stock and a purchase price for the stock. When a player is moved to one of the spaces, that player is permitted to purchase the stock represented by that stock space. A closing value for any stock purchased by the player is determined.

Other aspects and advantages of the present invention will be apparent from the following detailed description of the preferred embodiment and the accompanying drawing figures.

BRIEF DESCRIPTION OF THE DRAWING FIGURES

A preferred embodiment of the invention is described in detail below with reference to the attached drawing figures, wherein:

FIG. 1 is a top plan view of a game board for playing an investment game in accordance with the principles of the present invention;

FIG. 2*a* is an enlarged, fragmentary top plan view of a comer section of the game board;

FIG. 2*b* is an enlarged, fragmentary top plan view of a comer section of the game board adjacent to the section shown in FIG. 2*a;*

FIG. 2*c* is an enlarged, fragmentary top plan view of a corner section of the game board adjacent to the section shown in FIG. 2*b* and opposite from the section shown in FIG. 2*a;*

FIG. 2*d* is an enlarged, fragmentary top plan view of a corner section of the game board between the sections shown in FIGS. 2*c* and 2*a* and opposite from the section shown in FIG. 2*b;*

FIG. 2*e* is a schematic view of the game board, particularly illustrating the relative locations of the game board sections depicted in FIGS. 2*a–e;*

Figure 9A:
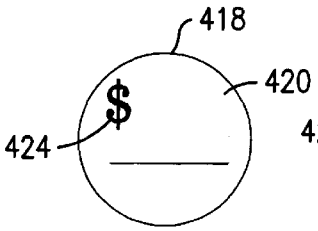
Figure 9B:
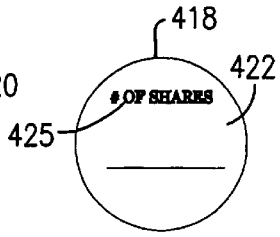
Figure 10A:
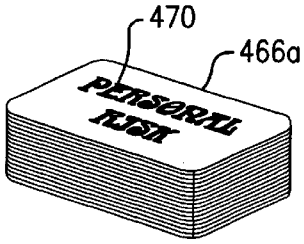
Figure 11A:
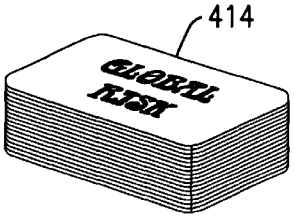
Figure 12A:
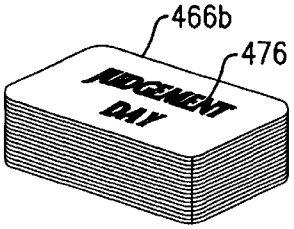
Figure 10B:
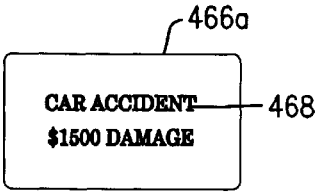
Figure 11B:
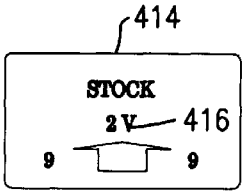

FIG. 9*a* is a plan view of the stock purchase price face of the laminated disk used to identify changes in the purchase price of one of the stocks;

FIG. 9*b* is a plan view of the opposite share face of the laminated disk;

FIG. 10*a* is a perspective view of a personal risk card set from which the player draws when the player moves to one of the personal risk spaces along the path;

FIG. 10*b* is a plan view of one of the personal risk cards;

FIG. 11*a* is a perspective view of a global risk card set from which the player draws when the player moves to one of the global risk spaces along the path;

FIG. 11*b* is a plan view of one of the global risk cards;

FIG. 12*a* is a perspective view of a judgement day card set from which the player draws when instructed to do so by one of the personal risk cards shown in FIG. 10*a;*

Figure 12B:
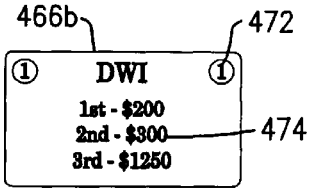
Figure 13A:
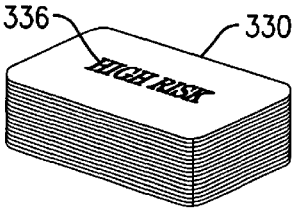
Figure 14A:
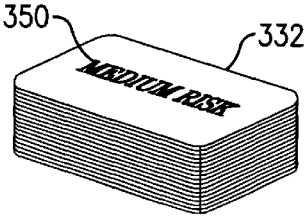
Figure 15A:
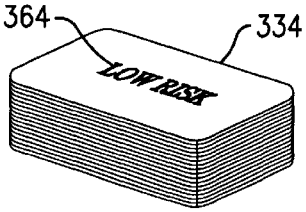
Figure 13B:
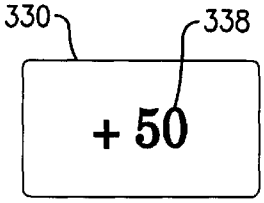
Figure 14B:
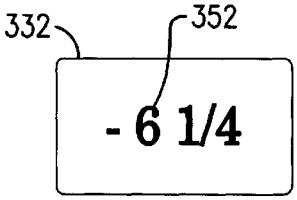
Figure 15B:
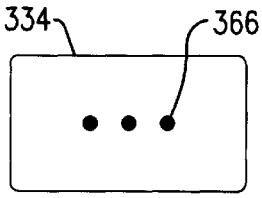

FIG. 12*b* is a plan view of one of the judgement day cards;

FIG. 13*a* is a perspective view of a high risk card set from which the player may draw when determining the closing value for a purchased stock;

FIG. 13*b* is a plan view of one of the high risk cards,

FIG. 14*a* is a perspective view of a medium risk card set from which the player may draw when determining the closing value for a purchased stock;

FIG. 14*b* is a plan view of one of the medium risk cards;

FIG. 15*a* is a perspective view of a low risk card set from which the player may draw when determining the closing value for a purchased stock; and FIG. 15*b* is a plain view of one of the low risk cards.

DETAILED DESCRIPTION OF THE PREFERRED EMBODIMENT

Figure 1:
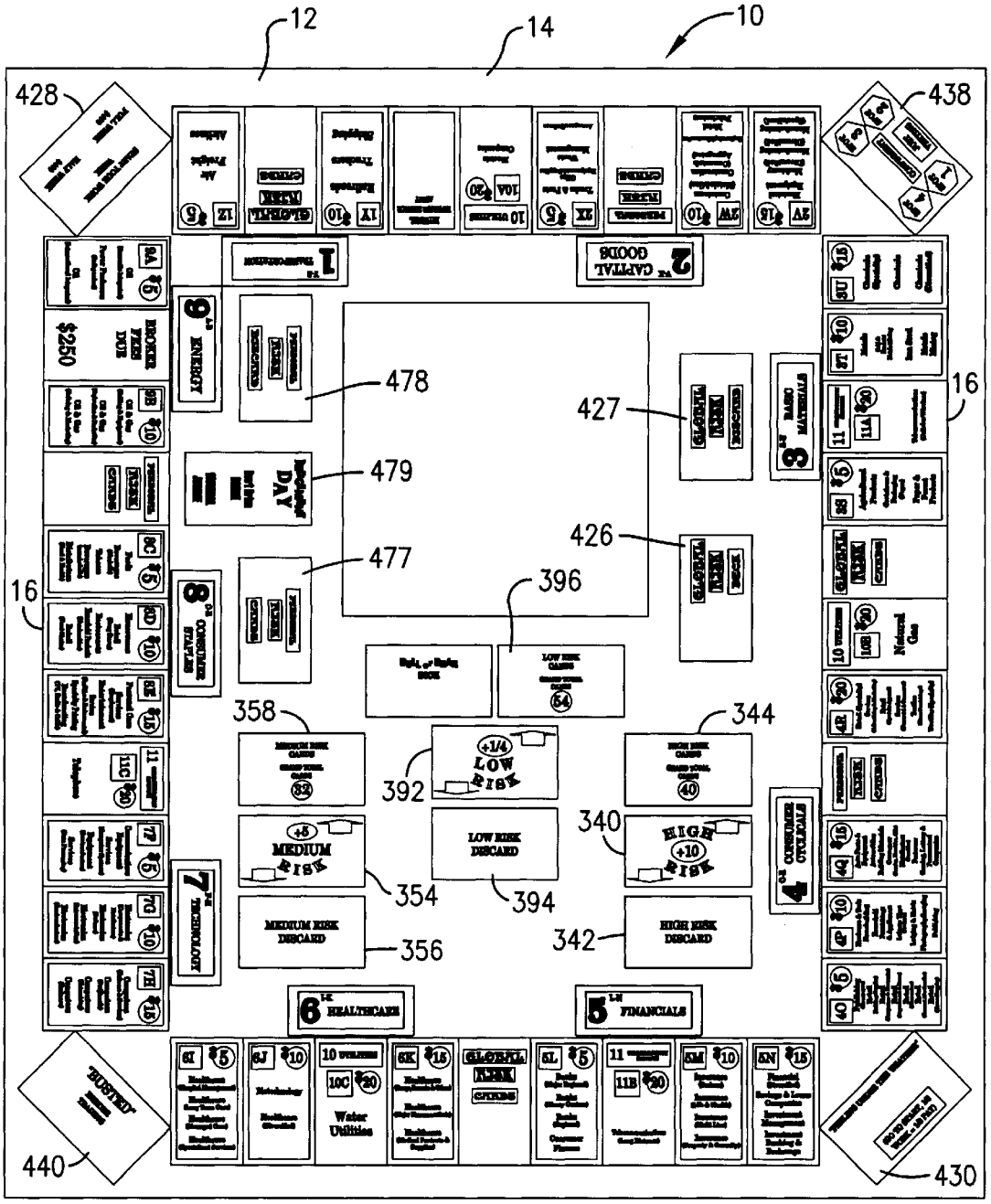

As shown FIG. 1, the board game 10 selected for illustration includes a board 12 that is generally rectangular in shape and formed of any suitable material. As is customary, the board 12 preferably comprises a laminated sheet that has at least one crease so that the sheet is foldable. As will subsequently be described, the top surface 14 of the board 12 is printed with various indicia to facilitate playing of the game.

A path 16 is defined about the perimeter of the board 12, with the path 16 being endless and rectangular in shape. The path 16 is primarily defined by a plurality of stock spaces, each of which represents a stock and a purchase price for the stock. In the iliustrated embodiment, there are thirty-two stock spaces arranged into eleven stock groups. It will be appreciated that the illustrated arrangement generally coincides with the commonly accepted categorization of the stocks traded on the New York Stock Exchange, and the stock groups therefore include "transportation", "capital goods", "basic materials", "consumer cyclicals", "financials", "health care", "technology", "consumer staples", "energy", "utilities", and "communication services."

Figure 2A:
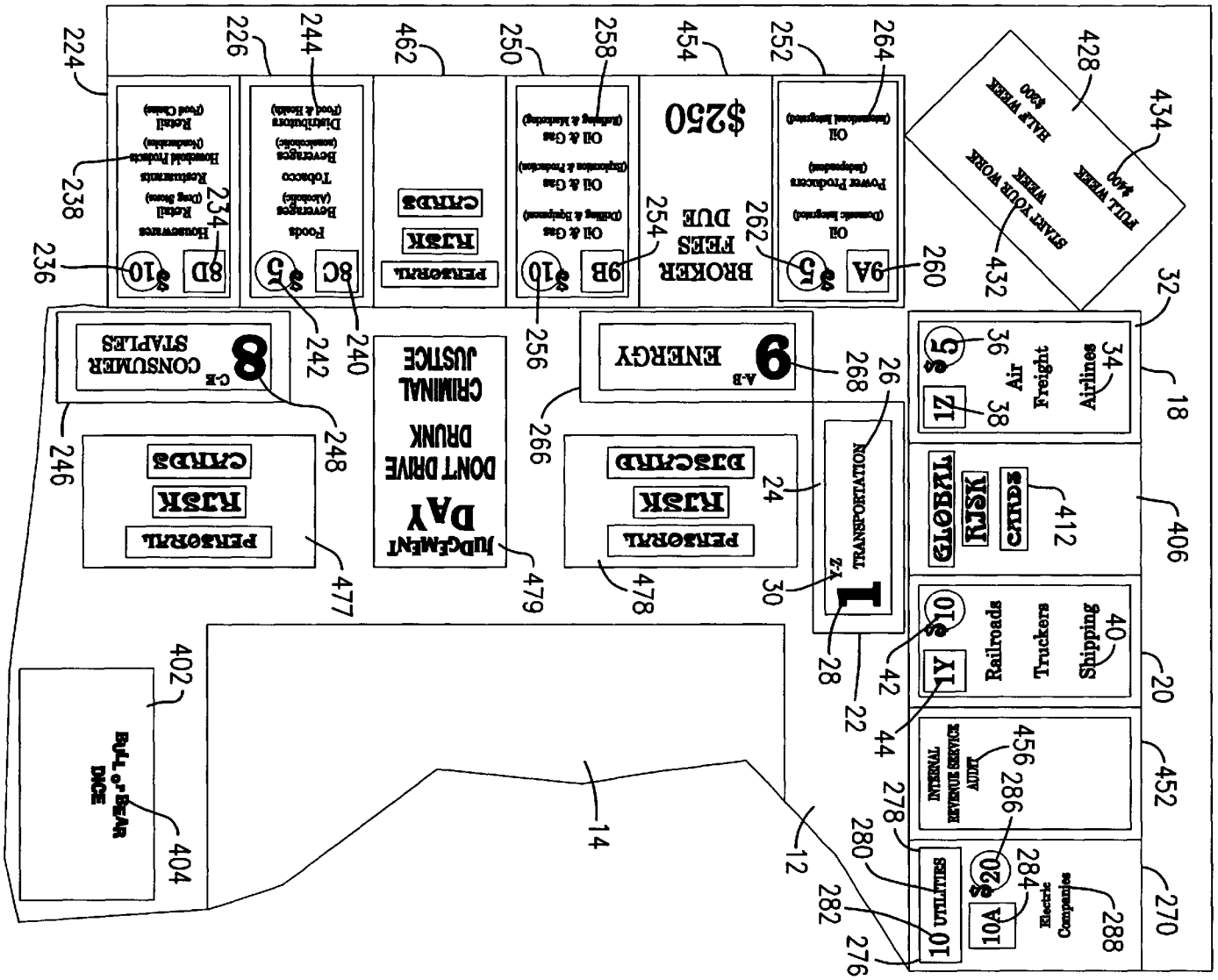

The transportation group of stock spaces includes two stock spaces 18 and 20 and an identification area 22 that is located adjacent but inward of the spaces 18,20 (see FIG. 2*a*). The identification area 22 includes a border 24 (preferably in the form of a colored strip), identification indicia 26 located inside the border 24, and group distinguishing indicia 28 also inside the border 24. The identification indicia is preferably in the form of the word "transportation" and therefore serves to identify the stocks of the associated spaces 18,20 as being part of the transportation group. The group distinguishing indicia 28 is preferably in the form of the numreral "1", and will be used throughout the game 10 to associate things with the transporation group. Associated with the group distinguishing indicia 28 is space indicia 30 that represents the stock spaces forming the group. It is noted that the transportation stock spaces 18 and 20 are separated by another space which will be described hereinbelow.

The first stock space 18 includes a border 32 that defines the perimeter of the space 18, stock identification indicia 34 located inside the border, purchase price indica 36 just inside the upper right corner of the border 32, and space identification indicia 38 just inside the upper left corner of the border 32. The illustrated stock identification indicia 34 is preferably in the form of the words "air freight" and "airlines". It will be appreciated that these words represent two of the commonly accepted subgroups of the transportation stock group of the New York Stock Exchange. It is entirely within the ambit of the present invention, however, to identify only one specific stock in the space 18. For example, the principles of the present invention are equally applicable to stock identification indicia that represents only one publicly traded company (if desired, such indicia may take the form of a recognizable trademark or service mark associated with the company). In any case, the illustrated purchase price indicia 36 consists of a dollar amount (i.e., five dollars) identifying the initial purchase price per share for the stock represented by the space 18. It is noted that the dollar amount is generally located within a circular area. If desired, the dollar amount may be removable so that the stock purchase price may be changed, as will subsequently be described. For example, the circular area may be laminated so that the player can enter an initial purchase price as instructed by the game rules and then change the purchase price as necessary. The space identification indicia 38 is in the form of the alphanumeric symbol "1Z", with the numeral "1" being the distinguishing indicia for the transportation group. The symbol indicia 38 further includes the letter "Z", as a result of the stock space 18 being the last of the twenty-six stock space symbols (moving counterclockwise around the board) that have letters cooperatively presenting the English alphabet.

The stock space 20 is generally similar in design to the stock space 18. Thus, it shall be sufficient to simply identify the distinctions. First, the stock identification indicia 40 of the stock space 20 includes the words "railroads", "truckers" and "shipping". It will be appreciated that the stock identification indicia of the stock space 20 represents the remaining commonly accepted subgroups of the transportation stock group of the New York Stock Exchange. That is to say, the stock identification indicia 34 and 40 cooperatively identify the commonly accepted subgroups of the transportation group of stocks in the New York Stock Exchange. Further, the purchase price indicia 42 of the stock space 20 is different from that of the stock space 18. In particular, the purchase price indicia of the stock space 20 identifies the initial purchase price per share as being ten dollars ($10). The space identification indicia similarly comprises an alphanumeric symbol including the group distinguishing indicia "1". However, because the stock space 20 makes up part of the set of alphabetical spaces, as noted above, the symbol includes the letter "Y". It is also noted that the letters "Z" and "Y", which form part of the space identification symbols 38,44 and distinguish the two transportation stock spaces 18 and 20 from one another, are reproduced as the space indicia 30 in the group identification area 22. The use of the space indicia 30 and space identification symbols 38,44 allow the players to readily associate the spaces with their stock group, and vice versa.

All of the other stock groups similarly include a plurality of closely located stock spaces and an inwardly spaced stock identification area, except for two of the stock groups which have spaces dispersed along the path and no identification area. The two exceptions include the utilities and communication services stock groups, and it is also noted that the spaces of the nine similarly arranged groups make up the twenty-six alphabetical spaces noted hereinabove. It is also noted that the stock spaces of each of the nine similarly arranged stock groups include stock identification indicia that cooperatively represent the commonly accepted subgroups of stocks for that stock group of the New York Stock Exchange. Because of the general similarities to the transportation group of stock spaces, the ten remaining stock groups will be briefly described with emphasis on any distinctions.

Figure 2B:
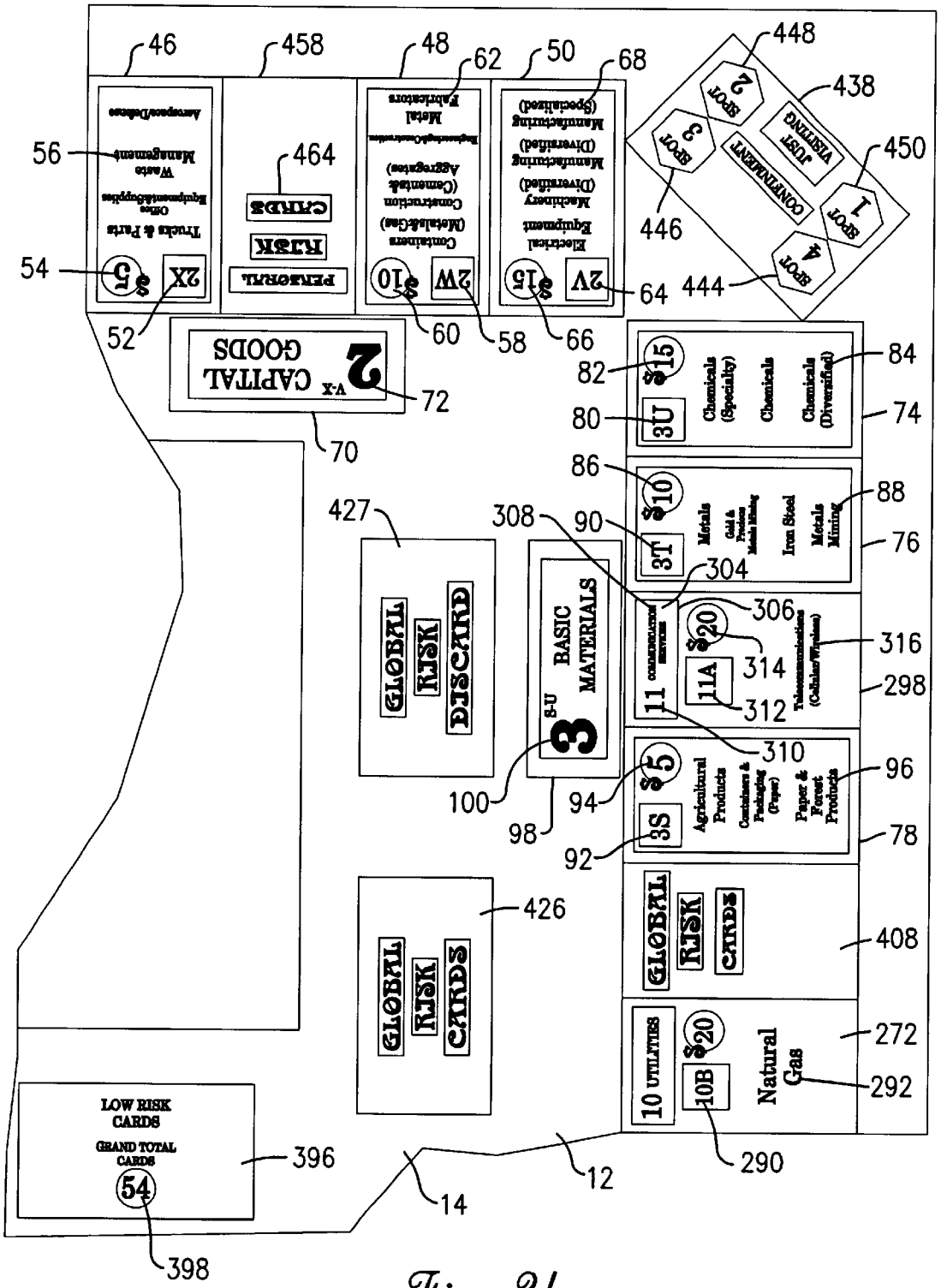

As perhaps best shown in FIG. 2*b*, the second stock group is capital goods and consists of three stock spaces 46,48,50. The first stock space 46 is spaced from the second space 48 by a space which will subsequently be described, while the second and third spaces 48 and 50 are adjacent one another. More particularly, the first stock space 46 preferably includes space identification indica 52 in the form of the symbol "2X", purchase price indicia 54 in the form of the amount "$5", and stock identification indicia 56 in the form of the words "trucks & parts", "office equipment & supplies", "waste management" and "aerospace/defense". The second capital goods stock space 48 preferably includes space identification indica 58 in the form of the symbol "2W", purchase price indicia 60 in the form of the amount "$10", and stock identification indicia 62 in the form of the words "containers (metals & gas)", "construction (cements & aggregates)", "engineering and construction" and "metal fabricators". The third capital goods stock space 50 preferably includes space identification indica 64 in the form of the symbol "2V", purchase price indicia 66 in the form of the amount "$15", and stock identification indicia 68 in the form of the words "electrical equipment", "machinery (diversified)", "manufacturing (diversified)" and "manufacturing (specialized)". The group identification area 70 for the capital goods stock group includes, among other things, the distinguishing indicia 72 for that group (i.e., the numeral "2"). It is also noted that the group distinguishing indicia forms part of the space symbols 52,58,64. As shown in FIG. 1, the spaces 46,48,50 of the capital goods stock group are located along the same side of the board 12 as the spaces 18,20 of the transportation stock group.

Returning to FIG. 2*b*, the third stock group is basic materials and consists of three stock spaces 74,76,78. The first and second stock spaces 74 and 76 are adjacent one another, while the second space 76 is separated from the third space 78 by one of the communication services spaces described hereinbelow. More particularly, the first basic materials stock space 74 preferably includes space identification indica 80 in the form of the symbol "3U", purchase price indicia 82 in the form of the amount "$15", and stock identification indicia 84 in the form of the words "chemicals (specialty)", "chemicals" and "chemicals (diversified)". The second basic materials stock space 76 preferably includes space identification indica 86 in the form of the symbol "3T", purchase price indicia 88 in the form of the amount "$10", and stock identification indicia 90 in the form of the words "metals", "gold & precious metals mining", "iron steel" and "metals mining". The third basic materials stock space 78 preferably includes space identification indica 92 in the form of the symbol "3S", purchase price indicia 94 in the form of the amount "$5", and stock identification indicia 96 in the form of the words "agricultural products", "containers & packaging (paper)" and "paper & forest products". The group identification area 98 for the basic materials stock group includes, among other things, the distinguishing indicia 100 for that group (i.e., the numeral "3"). It is also noted that the group distinguishing indicia forms part of the space symbols 80,86,92. As shown in FIG. 2*b*, the spaces 74,76,78 of the basic materials stock group arc located along the side of the board 12 that is adjacent but perpendicular to the side along which the capital goods stock spaces 46,48,50 are located.

Figure 2C:
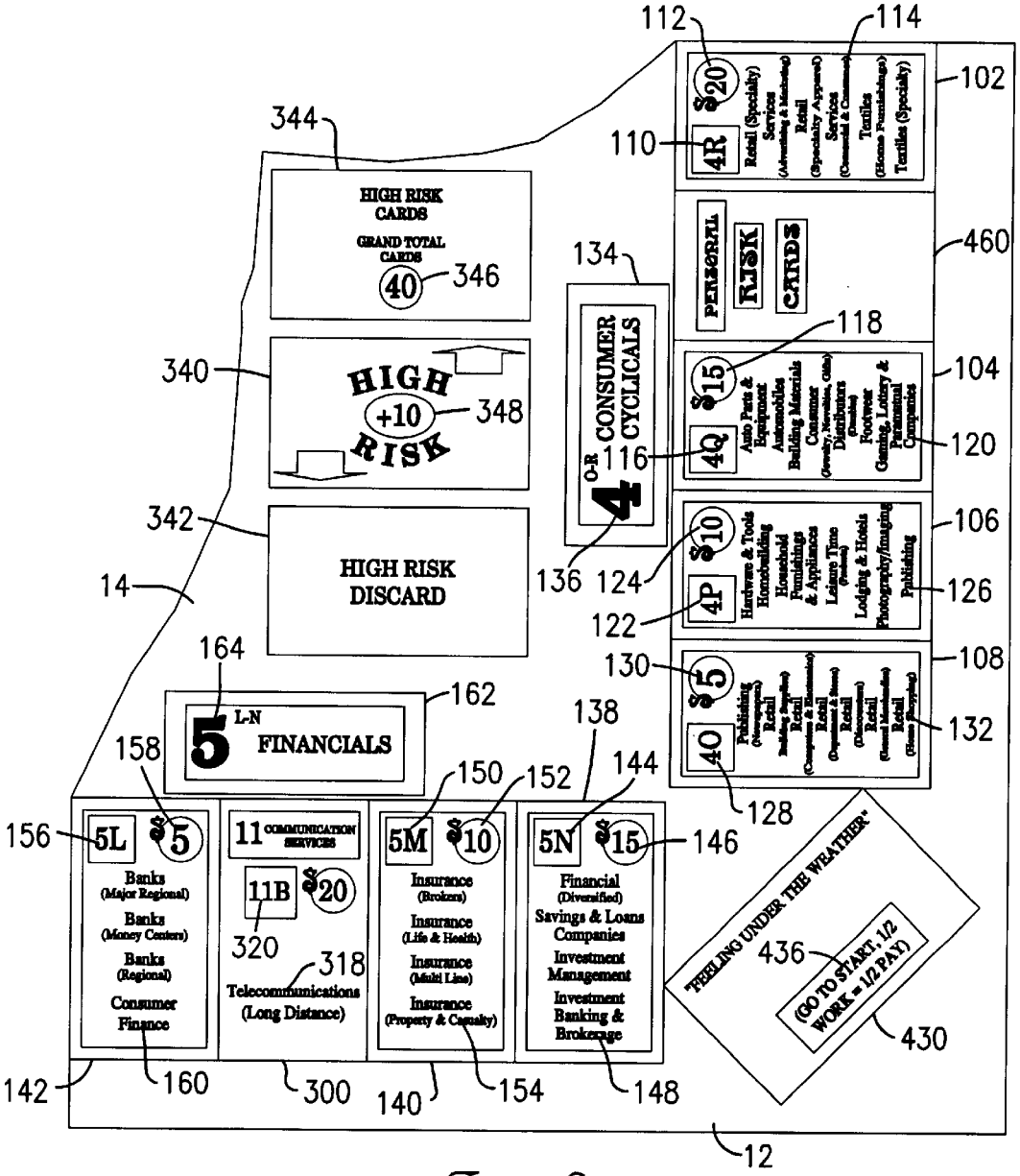
Figure 2E:
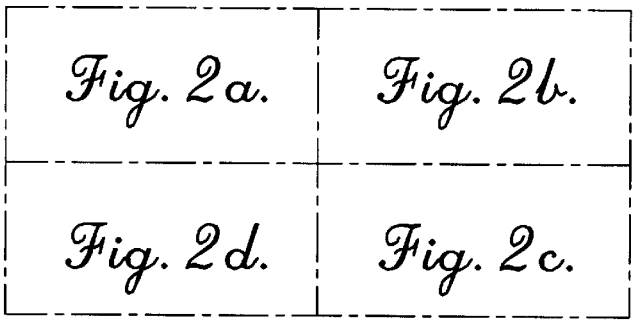

As perhaps best shown in FIG. 2*c*, the fourth stock group is consumer cyclicals and consists of four stock spaces 102,104,106,108. The first stock space 102 is separated from the second space 104 by a space which will subsequently be described, while the second, third and fourth spaces 104, 106,108 are adjacent one another. More particularly, the first stock space 102 preferably includes space identification indica 110 in the form of the symbol "4R" purchase price indicia 112 in the form of the amount "$20", and stock identification indicia 114 in the form of the words "retail (specialty)", "services (advertising & marketing)", "retail (specialty apparel)", "services (commercial & consumer)", "textiles (home furnishings)", and "textiles (specialty)". The second consumer cyclical stock space 104 preferably includes space identification indica 116 in the form of the symbol "4Q", purchase price indicia 118 in the form of the amount "$15", and stock identification indicia 120 in the form of the words "auto parts & equipment", "automobiles", "building materials", "consumer (jewelry, novelties, gifts)", "distributors (durables)", "footwear", and "gaming, lottery & parimutuel companies". The third consumer cyclicals stock space 106 preferably includes space identification indica 122 in the form of the symbol "4P", purchase price indicia 124 in the form of the amount "$10", and stock identification indicia 126 in the form of the words "hardware & tools", "home building", "household furnishings & appliances", "leisure time (products)", "lodging & hotels", "photography/imaging" and "publishing". The fourth consumer cyclicals stock space 108 preferably includes space identification indica 128 in the form of the symbol "4O", purchase price indicia 130 in the form of the amount "$5", and stock identification indicia 132 in the form of the words "publishing (newspapers)", "retail (building supplies)", "retail (computers & electronics)", "retail (department & stores)", "retail (discounters)", "retail (general merchandise)" and "retail (home shopping). The group identification area 134 for the consumer cyclicals stock group includes, among other things, the distinguishing indicia 136 for that group (i.e., the numeral "4"). It is also noted that the group distinguishing indicia forms part of the space symbols 110,116,122,128. As shown in FIG. 1, the spaces 102,104,106,108 of the consumer cyclicals stock group are located along the same side of the board 12 as the spaces 74,76,78 of the basic materials stock group.

As also shown in FIG. 2*c*, the fifth stock group is financials and consists of three stock spaces 138,140,142. The first and second stock spaces 138,140 are adjacent one another, while the second and third stock spaces 140,142 are separated by one of the communication services spaces described hereinbelow. More particularly, the first stock space 138 preferably includes space identification indica 144 in the form of the symbol "5N", purchase price indicia 146 in the form of the amount "$15", and stock identification indicia 148 in the form of the words "financial (diversified)", "savings & loans companies", "investment management" and "investment banking & brokerage". The second financials stock space 140 preferably includes space identification indica 150 in the form of the symbol "5M", purchase price indicia 152 in the form of the amount "$10", and stock identification indicia 154 in the form of the words "insurance (brokers)", "insurance (life & health)", "insurance (multi line)" and "insurance (property & casualty)". The third financials stock space 142 preferably includes space identification indica 156 in the form of the symbol "5L", purchase price indicia 158 in the form of the amount "$5", and stock identification indicia 160 in the form of the words "banks (major regional)", "banks (money centers)", "banks (regional)" and "consumer finance". The group identification area 162 for the financials stock group includes, among other things, the distinguishing indicia 164 for that group (i.e., the numeral "5"). It is also noted that the group distinguishing indicia forms part of the space symbols 144,150,156. As shown in FIG. 2*c*, the spaces 138,140,142 of the financials stock group are located along the side of the board 12 that is adjacent but perpendicular to the side along which the consumer cyclicals stock spaces 102,104,106,108 are located.

Figure 2D:
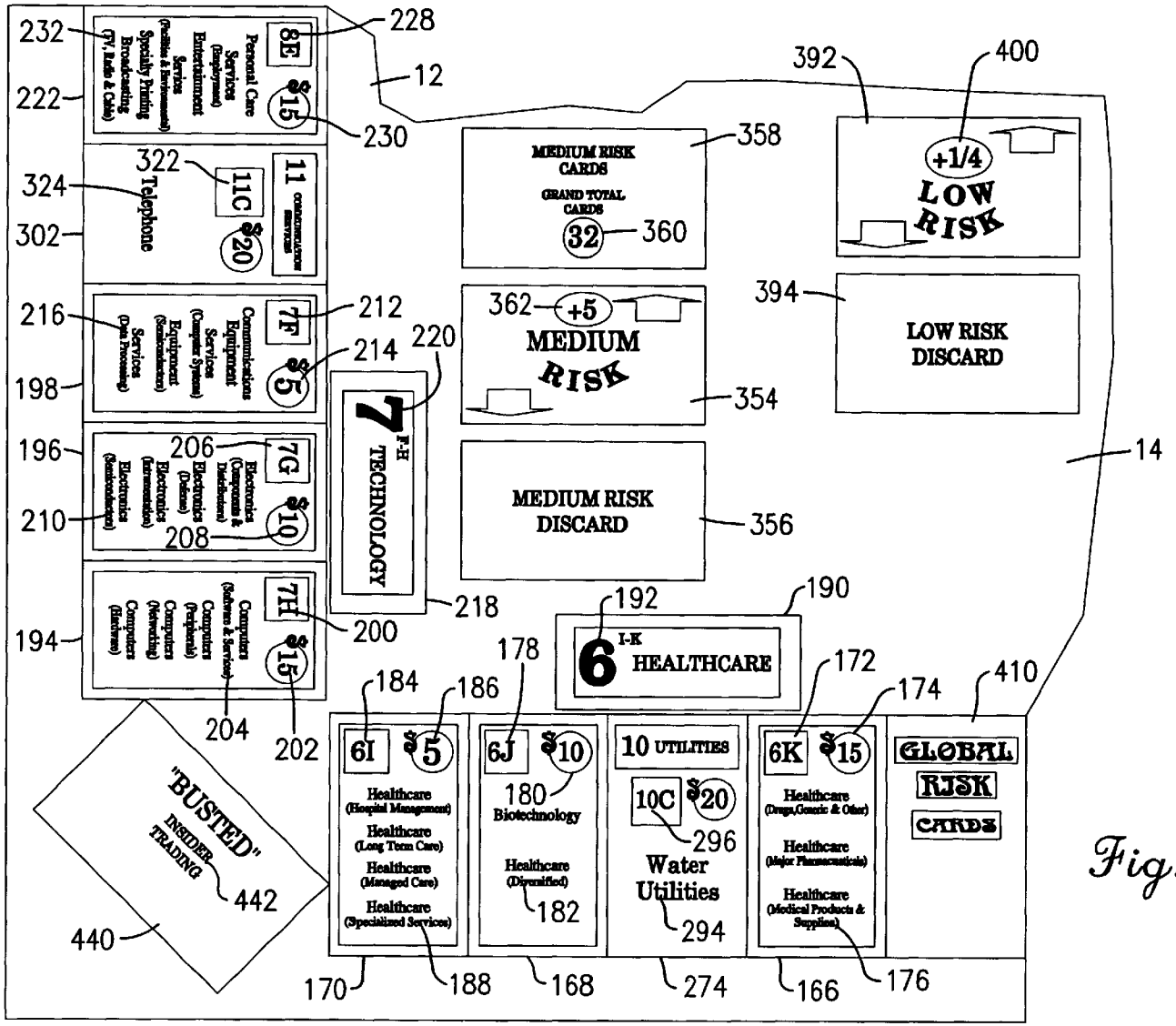

As perhaps best shown in FIG. 2*d*, the sixth stock group is healthcare and consists of three stock spaces 166,168,170. The first stock space 166 is separated from the second space 168 by one of the utilities stock spaces described hereinbelow, while the second and third spaces 168,170 are adjacent one another. More particularly, the first stock space 166 preferably includes space identification indica 172 in the form of the symbol "6K", purchase price indicia 174 in the form of the amount "$15", and stock identification indicia 176 in the form of the words "healthcare (drugs, generic & other)", "healthcare (major pharmaceuticals)" and "healthcare (medical products & supplies)". The second healthcare stock space 168 preferably includes space identification indica 178 in the form of the symbol "6J", purchase price indicia 180 in the form of the amount "$10", and stock identification indicia 182 in the form of the words "biotechnology" and "healthcare (diversified)". The third healthcare stock space 170 preferably includes space identification indica 184 in the form of the symbol "6I", purchase price indicia 186 in the form of the amount "$5", and stock identification indicia 188 in the form of the words "healthcare (hospital management)", "healthcare (long term care)", "healthcare (managed care)" and "healthcare (specialized services)". The group identification area 190 for the healthcare stock group includes, among other things, the distinguishing indicia 192 for that group (i.e., the numeral "6"). It is also noted that the group distinguishing indicia forms part of the space symbols 172,178,184. As shown in FIG. 1, the spaces 166,168,170 of the healthcare stock group are located along the same side of the board 12 as the spaces 168,140, 142 of the financials stock group.

As perhaps best shown in FIG. 2*d*, the seventh stock group is technology and consists of three stock spaces 194,196,198, all of which are adjacent one another. The first stock space 194 preferably includes space identification indica 200 in the form of the symbol "7H", purchase price indicia 202 in the form of the amount "$15", and stock identification indicia 204 in the form of the words "computers (software & services)", "computers (peripherals)", "computers (networking)" and "computers (hardware)". The second technology stock space 196 preferably includes space identification indica 206 in the form of the symbol "7G", purchase price indicia 208 in the form of the amount "$10", and stock identification indicia 210 in the form of the words "electronics (components & distributors)", "electronics (defense)", "electronics (instrumentation)" and "electronics (semiconductors)". The third technology stock space 198 preferably includes space identification indica 212 in the form of the symbol "7F", purchase price indicia 214 in the form of the amount "$5", and stock identification indicia 216 in the form of the words "communications equipment", "services (computer systems)", "equipment (semiconductors)" and "services (data processing)". The group identification area 218 for the technology stock group includes, among other things, the distinguishing indicia 220 for that group (i.e., the numeral "7"). It is also noted that the group distinguishing indicia forms part of the space symbols 200,206,212. As shown in FIG. 2*d*, the spaces 194,196,198 of the technology stock group are located along the side of the board 12 that is adjacent but perpendicular to the side along which the healthcare stock spaces 166,168,170 are located.

As perhaps best shown in FIGS. 2*d* and 2*a*, the eighth stock group is consumer staples and consists of three stock spaces 222,224,226, all of which are adjacent one another. The first stock space 222 preferably includes space identification indica 228 in the form of the symbol "8E", purchase price indicia 230 in the form of the amount "$15", and stock identification indicia 232 in the form of the words "personal care", "services (employment)", "entertainment", "services (facilities & environmental)", "specialty printing" and "broadcasting (TV, radio & cable)". The second consumer staples stock space 224 preferably includes space identification indica 234 in the form of the symbol "8D", purchase price indicia 236 in the form of the amount "$10", and stock identification indicia 238 in the form of the words "housewares", "retail (drug stores)", "restaurants", "household products (nondurables)" and "retail (food chains)". The third consumer staples stock space 226 preferably includes space identification indica 240 in the form of the symbol "8C", purchase price indicia 242 in the form of the amount "$5", and stock identification indicia 244 in the form of the words "foods", "beverages (alcoholic)", "tobacco", "beverages (nonalcoholic)" and "distributors (food & health)". The group identification area 246 for the consumer staples stock group includes, among other things, the distinguishing indicia 248 for that group (i.e., the numeral "8"). It is also noted that the group distinguishing indicia forms part of the space symbols 228,234,240. As shown in FIG. 1, the spaces 222,224,226 of the consumer staples stock group are located along the same side of the board 12 as the spaces 194,196, 198 of the technology stock group.

As perhaps best shown in FIG. 2*a*, the ninth stock group is energy and consists of two stock spaces 250,252. The spaces 250,252 are separated by a space which will be described further. More particularly, the first stock space 250 preferably includes space identification indica 254 in the form of the symbol "9B", purchase price indicia 256 in the form of the amount "$10", and stock identification indicia 258 in the form of the words "oil & gas (drilling & equipment)", "oil & gas (exploration & production)" and "oil & gas (refining & marketing)". The second energy stock space 252 preferably includes space identification indica 260 in the form of the symbol "9A", purchase price indicia 262 in the form of the amount "$5", and stock identification indicia 264 in the form of the words "oil (domestic integrated)", "power producers (independent)" and "oil (international integrated)". The group identification area 266 for the energy stock group includes, among other things, the distinguishing indicia 268 for that group (i.e., the numeral "9"). It is also noted that the group distinguishing indicia forms part of the space symbols 254,260. As shown in FIG. 2*a*, the spaces 250,252 of the energy stock group are located along the same side of the board 12 as the spaces 222,224, 226 of the consumer staples stock group.

The utilities stock group includes three stock spaces 270,272,274. The first utilities stock space 270 is located adjacent the first capital goods stock space 46 (see FIGS. 2*a* and 2*b*). The second utilities stock space 272 is located adjacent the first consumer cyclicals stock space 102. The third utilities stock space 274 is located between the first and second healthcare stock spaces 166,168. The utilities stock spaces 270,272,274 are identical in design, except for differences in the space identification indicia and stock identification indicia. It shall therefore be sufficient to detailedly describe one of the utilities stock spaces and then simply identify the distinctions of the others.

As shown in FIG. 2*a*, adjacent the top of the first utilities stock space 270 is a group identification area 276 including a border 278, group identification indicia 280 located inside the border 278, and group distinguishing indicia 282 also inside the border 278. The identification indicia 280 is preferably in the form of the word "utilities" and therefore serves to identify the space 270 as being part of the utilities stock group. The group distinguishing indicia 282 is preferably in the form of the numeral "10" and will be used throughout the game to associate things with the utilities group. Similar to the previously described stock spaces, the stock space 270 further includes space identification indicia 284 in the form of the symbol "10A", purchase price indicia 286 in the form of the amount "$20", and stock identification indica 288 in the form of the words "electric companies". The utilities stock spaces 270,272,274 all include the same purchase price indicia and group identification area. Furthermore, the stock identification indicia of the spaces 270,272,274 cooperatively present the commonly accepted subgroups of the utilities stock group of the New York Stock Exchange. With particular respect to the distinctions, the second utilities stock space 272 includes space identification indicia 290 in the form of the symbol "10B" and stock identification indica 292 in the form of the words "natural gas" (see FIG. 2*b*). The third utilities stock space 274 includes space identification indicia 294 in the form of the symbol "10C" and stock identification indicia 296 in the form of the words "water utilities" (see FIG. 2*d*).

The communication services stock group also includes three stock spaces 298,300,302. The first communication services stock space 298 is located between the second and third basic materials stock spaces 76 and 78 (see FIG. 2*b*). The second communication services stock space 300 is located between the second and third financials stock spaces 140 and 142 (see FIG. 2*c*). The third communication services stock space 302 is located between the third technology stock space 198 and the first consumer staples stock space 222 (see FIG. 2*d*). The communication services stock spaces 298,300,302 are identical in design, except for differences in the space identification indicia and stock identification indicia. It shall therefore be sufficient to detailedly describe one of the communication services stock spaces and then simply identify the distinctions of the others.

As shown in FIG. 2*b*, adjacent the top of the first communication services stock space 298 is a group identification area 304 including a border 306, group identification indicia 308 located inside the border 278, and group distinguishing indicia 310 also inside the border 278. The identification indicia 308 is preferably in the form of the words "communication services" and therefore serves to identify the space 298 as being part of the communication services stock group. The group distinguishing indicia 310 is preferably in the form of the numeral "11" and will be used throughout the game to associate things with the communication services group. Similar to the previously described stock spaces, the stock space 298 further includes space identification indicia 312 in the form of the symbol "11A", purchase price indicia 314 in the form of the amount "$20", and stock identification indica 316 in the form of the words "telecommunications (cellular/wireless)". The communication services stock spaces 298,300,302 all include the same purchase price indicia and group identification area. Furthermore, the stock identification indicia of the spaces 298,300,302 cooperatively present the commonly accepted subgroups of the communication services stock group of the New York Stock Exchange. With particular respect to the distinctions, the second communication services stock space 300 includes space identification indicia 318 in the form of the symbol "11B" and stock identification indica 320 in the form of the words "telecommunications (long distance)" (see FIG. 2*c*). The third communication services stock space 302 includes space identification indicia 322 in the form of the symbol "11C" and stock identification indicia 324 in the form of the word "telephone" (see FIG. 2*d*).

Figure 8:
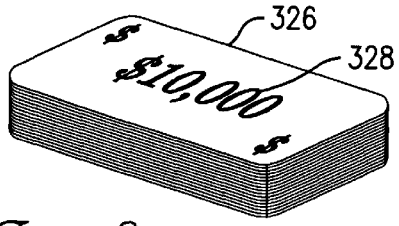
FIG. 8 is a perspective view of the faux bills used by the players to purchase stock.

When one of the players moves or is moved to one of the stock spaces, that player is given the opportunity to purchase the stock represented by that space. Because the illustrated purchase prices for the stock spaces are represented in dollar amounts, the preferred monetary system used to purchase stocks comprises a plurality of faux bills 326 (see FIG. 8). Each of the bills 326 includes value indicia 328 (e.g., "$10,000") identifying the dollar amount the bill represents. Preferably, the denominations of the bills are $25, $50, $100, $500, $1,000, $5,000 and $10,000. The game 10 is preferably provided with fifty $25 bills, fifty $50 bills, one hundred $100 bills, fifty $500 bills, one hundred $1,000 bills, fifty $5,000 bills and thirty $10,000 bills; although the type of denominations and the number of bills of each denomination may be varied if desired. It is noted that each of the players is preferably provided with bills having a total value of $25,000 at the start of the game.

As will be described further below, when stock is purchased by a player, a closing value for the purchased stock is determined. In other words, the purchased stock has the potential to immediately change value. The closing value is determined by using a chance indicator which, in the illustrated embodiment, instructs the player to either change the stock value a given amount or to make no change in the present stock value. The preferred game methodology also requires the player to use the chance indicator when landing on a stock space for which stock has already been purchased. In the illustrated embodiment, the chance indicator comprises a plurality of high risk stock value cards 330 (see FIGS. 13*a* and 13*b*), a plurality of medium risk stock value cards 332 (see FIGS. 14*a* and 14*b*), a plurality of low risk stock value cards 334 (see FIGS. 15*a* and 15*b*), and a stock value die 335 (see FIG. 6). Each of the cards 330,332,334 identifies either a change or no change in stock value. As will subsequently be indicated, the high risk cards 330 have the potential of increasing the stock value a greater amount than the medium risk cards 332 but also present a relatively greater risk of decreasing the stock value than the medium risk cards 332. The same may be said of the medium risk cards 332 relative to the low risk cards 334.

The top face of each high risk stock value card 330 includes identification indicia 336 so that the card is quickly recognizable as being part of the high risk card set. As shown in FIG. 13*a*, the identification indicia 336 preferably includes the words "high risk". The opposite bottom face of the high risk card 330 is provided with value change indicia 338 representing a change in stock value or no change indicia (not shown) representing no change in stock value. The value change indicia 338 of the high risk cards 330 preferably identifies whether it is to be considered an increase or decrease in stock value. As shown in FIG. 13*b*, the indicia 338 includes the symbol "+" to represent an increase in stock value, and it will be appreciated that a decrease in stock value is represented by the symbol "–".

The principles of the present invention are equally applicable to various other symbols or means for distinguishing between an increase and decrease in stock value. For example, color coding may be used, such as coloring the value change amount in green to represent an increase in value or in red to represent a decrease. The no change indicia is preferably in the form of an ellipses (e.g., " . . . ").

There are preferably a total of forty high risk cards 330, seven of which include no change indicia, eleven of which include value change inclicia 338 representing an increase in stock value and twenty-two of which include value change indicia 338 representing a decrease in stock value. The eleven cards with stock value increase indicia preferably represent dollar increase amounts per share as follows: one card identifying an increase of $3.25, one card identifying an increase of $6.25, one card identifying an increase of $12.50, three cards identifying an increase of $25.00, two cards identifying an increase of $75.00 and one card identifying an increase of $100.00. The twenty-two cards with stock value decrease indicia preferably represent dollar decrease amounts per share as follows: one card identifying a decrease of $0.75, three cards identifying a decrease of $1.50, four cards identifying a decrease of $3.25, one card identifying a decrease of $4.25, four cards identifying a decrease of $6.25, one card identifying a decrease of $9.50, three cards identifying a decrease of $12.50, one card identifying a decrease of $18.75, two cards identifying a decrease of $25.00, one card identifying a decrease of $37.50 and one card identifying a decrease of $50.00.

As perhaps best shown in FIG. 2*c*, the illustrated board 12 is provided with an undrawn high risk card space 340 and a drawn high risk card space 342, both of which are spaced inward of the financials group identification area 162. The high risk cards that have not been drawn by one of the players are stacked on the space 340, while drawn cards are discarded to the space 342. The board 12 is preferably also provided with a high risk card listing space 344 that includes indicia 346 identifying the total number of high risk cards 330. Although not shown, the preferred indicia 346 also identifies the number of cards having no change indicia, the number of cards having stock value increase indicia, the number of cards having stock value decrease indicia, and each of the various amounts of increase or decrease in stock value represented by the cards having value change indicia 338. The card listing space 344 is aligned with and spaced just inward of the undrawn card space 340. It is also noted that the undrawn high risk card space 340 includes minimum stock value indicia 348 in the form of the dollar amount "10". As will subsequently be described, the players are limited to selecting among the high, medium and low risk cards depending upon the present value of the stock for which the closing value is being determined. Particularly, the player is not permitted to draw one of the high risk cards 330 unless the present per share value of the stock is at least the value represented by the indicia 348.

Similar to the high risk cards 330, the top face of each medium risk stock value card 332 includes identification indicia 350 so that the card is quickly recognizable as being part of the medium risk card set. As shown in FIG. 14*a*, the identification indicia 350 preferably includes the words "medium risk". The opposite bottom face of the medium risk card 332 is provided with value change indicia 352 representing a change in stock value or no change indicia (not shown) representing no change in stock value. Another similarity to the high risk cards 330 is that the value change indicia 352 identifies whether it is to be considered an increase or decrease in stock value. As shown in FIG. 14*b*, the indicia 352 includes the symbol "–" to represent a decrease in stock value, and it will be appreciated that an increase in stock value is represented by the symbol "+". As with the high risk cards 330, various alternatives to the symbols may be used. Furthermore, the no change indicia is preferably in the form of an ellipses (e.g., " . . . ").

There are preferably a total of thirty-two medium risk cards 332, six of which include no change indicia, ten of which include value change indicia 352 representing an increase in stock value and sixteen of which include value change indicia 352 representing a decrease in stock value. The ten cards with stock value increase indicia preferably represent dollar increase amounts per share as follows: one card identifying an increase of $3.25, three cards identifying an increase of $6.25, two cards identifying an increase of $12.25, one card identifying an increase of $18.75, one card identifying an increase of $25.00, one card identifying an increase of $37.75 and one card identifying an increase of $50.00. The sixteen cards with stock value decrease indicia preferably represent dollar decrease amounts per share as follows: one card identifying a decrease of $0.75, five cards identifying a decrease of $1.50, four cards identifying a decrease of $3.25, three cards identifying a decrease of $6.25, two cards identifying a decrease of $12.50 and one card identifying a decrease of $25.00.

Similar to the spaces 340,342,344 for the high risk card set, the illustrated board 12 is provided with an undrawn medium risk card space 354, a drawn medium risk card space 356 and a medium risk card listing space 358 (see FIG. 2*d*). The medium risk card spaces 354,356,358 are aligned relative to one another and spaced inward of the healthcare group identification area 190. It will be appreciated that the medium risk card spaces 354,356,358 are similar to the high risk card spaces 340,342,344. Particularly, the card listing space 358 identifies the same type of information identified by the high risk card listing space 344, such that the space 358 includes indicia 360 identifying, among other things, each of the medium risk cards 332. Furthermore, the undrawn medium risk card space 354 includes minimum stock value indicia 362 in the form of the dollar amount "5".

Similar to the both the high and medium risk cards 330 and 332, the top face of each low risk stock value card 334 includes identification indicia 364 so that the card is quickly recognizable as being part of the low risk card set. As shown in FIG. 15*a*, the identification indicia 364 preferably includes the words "low risk". The opposite bottom face of the low risk card 334 is provided with value change indicia (not shown) representing a change in stock value or no change indicia 366 representing no change in stock value. As previously noted, the no change indicia 366 is preferably in the form of an ellipses (e.g., " . . . "). Moreover, contrary to the high and medium risk cards 330 and 332, the value change indicia of the low risk cards 334 does not indicate whether it is to be considered an increase or decrease in stock value. But rather the stock value die 335 is used by the player to determine whether the value change indicia involves an increase or decrease in stock value or whether the value change indicia should be ignored altogether. If desired, it is entirely within the ambit of the present invention to provide value change indicia on the high and medium risk cards that, similar to the low risk cards 334, does not indicate whether the change should be considered an increase or decrease in stock value. In this respect, the stock value die 335 or some alternative die or mechanism may be used with such alternative medium and high risk cards to determine whether the value change indicia shall be considered an increase or decrease in stock value.

Figure 6:
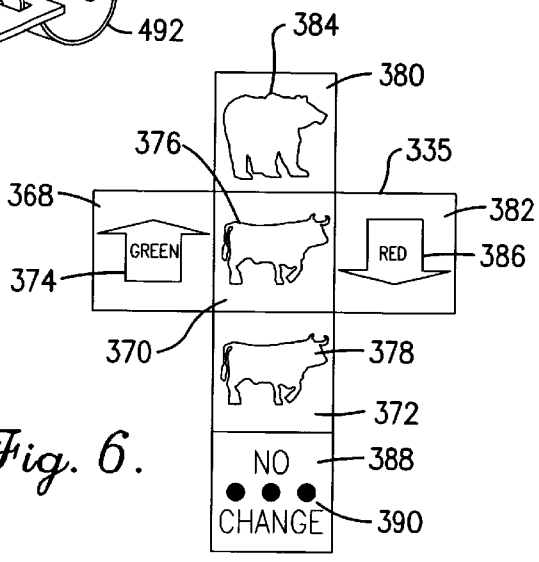
FIG. 6 is a schematic representation of the sides of the six-sided stock value die used when a card from the low risk card set is drawn by one of the players.

As shown in FIG. 6, the stock value die 335 is a standard six-sided die, however, the indicia provided on the sides is unique to this game. Particularly, three of the sides 368,370, 372 include respective indicia 374,376,378 indicating that the value change indicia of the low risk card should be considered an increase in stock value. It is particularly noted that there are two forms of stock value increase indicia, one in the shape of a bull (indicia 376,378) to represent a bull market and another in the shape of an green-colored arrow (indicia 374) so as to be consistent with the color-coding of the high and medium risk cards 330 and 332. Two sides 380,382 of the die 335 include respective stock value decrease indicia 384,386. Similar to the stock value increase indicia 374,376,378, the stock value decrease indicia 384, 386 is in two forms, one in the shape of a bear (indicia 384) to represent a bear market and another in the shape of a red-colored arrow (indicia 386) so as to be consistent with the color-coding of the high and medium risk cards 330 and 332. The final side 388 of the die 335 includes indicia 390 representing no change in stock value. As shown in FIG. 6, the indicia 390 preferably includes the words "no change" and an ellipses.

A player who decides to draw one of the low risk cards 334 is preferably required to roll the die 335 before the card is drawn, although it entirely within the ambit of the present invention to roll the die 335 after the low risk card is drawn. In this respect, there is no need for the player to draw a low risk card 334 when the no change side 388 of the die 335 is rolled. However, if any of the other sides 368,370,372,380, 382 of the die are rolled, the player must select one of the low risk cards 334. If the game alternatively involves drawing a low risk card 334 before the die 335 is rolled, then the die 335 need not be rolled when a low risk card 334 having no change indicia 366 is drawn.

There are preferably a total of fifty-four low risk cards 334, seven of which include no change indicia 366 and forty-seven of which include value change indicia. The forty-seven cards with value change indicia preferably represent dollar change amounts per share as follows: sixteen cards identifying a change of $0.25, ten cards identifying a change of $0.50, six cards identifying a change of $0.75, five cards identifying a change of $1.00, four cards identifying a change of $2.00, three cards identifying a change of $3.00, two cards identifying a change of $4.00 and one card identifying a change of $5.00.

It is noted that the board 12 is also provided with an undrawn low risk card space 392 (see FIG. 2*d*), a drawn low risk card space 394 and a low risk card listing space 396 (see FIG. 2*b*). The undrawn and drawn card spaces 392 and 394 are aligned relative to one another and spaced between the high risk card spaces 340,344 and medium risk card spaces 354,358. The card listing space 396 is spaced inward and offset to the right of the undrawn card space 392. The low risk card spaces 392,394,396 are similar to the high risk card spaces 340,342,344 and medium risk card spaces 354,356, 358. It is particularly noted that the low risk card listing space 396 preferably includes indicia 398 identifying each of the low risk cards 334, as well as other information similar to that described above with respect to the high risk card listing indicia 346. Furthermore, the undrawn low risk card space 392 includes minimum stock value indicia 400 in the form of the dollar amount "¼". The board 12 is also provided with a stock value die space 402 located alongside the card listing space 396 (see FIGS. 1 and 2*a*). If desired, the stock value die 335 may be located on the space 402 when it is not being used. Moreover, the stock value space 402 is provided with indicia 404 in the form of the words "bull or bear dice" to identify the stock value die 335. Although not shown, the indicia 404 preferably also identifies each of the sides of the die 335.

In view of the foregoing, it will be appreciated that there is a greater risk of reducing the stock value when drawing one of the high risk cards 330 as opposed to the medium risk cards 332. However, the possible increases in stock value are higher with the high risk cards 330 than those of the medium risk cards 332. The same relationships may be said of the medium risk cards 332 relative to the low risk cards 334 (taking into account of course the stock value die 335). The low risk cards 334 cooperatively present the lowest risk of reducing the stock value but also provide the smallest potential increases in stock values. The high risk cards 330 cooperatively present the highest risk of reducing stock value and the greatest potential stock value reduction amounts but also the greatest potential stock value increase amounts. The medium risk cards 332 fall somewhere between the low and high risk card sets.

It is particularly noted that the high risk cards 330 cooperatively present a range of change values (i.e., from a decrease of $50.00 per share to an increase of $100.00 per share) that is greatcr than the range of change values for the medium risk cards 332 (i.e., from a decrease of $25.00 per share to an increase of $50.00 per share). Both of these ranges are greater than the range of change values for the low risk cards 334 (i.e., no more than $5.00 increase or decrease). In addition, there are twice as many high risk cards 330 having value change indicia representing a stock value decrease than cards having value change indicia representing a stock value increase (i.e., twenty-two high risk cards with stock value decrease indicia versus eleven cards with stock value increase indicia). Similarly, there are a greater number of medium risk cards 332 having stock decrease indicia than medium risk cards having stock increase indicia (i.e., sixteen cards with stock value decrease indicia versus ten cards with stock value increase indicia). It will also be appreciated that the high risk card set has a greater proportion of cards with stock value decrease indicia to cards with stock value increase indicia than the medium risk card set. Furthermore, when drawing one of the low risk cards 334, there is a greater likelihood that the stock value will increase than decrease. This is attributable to the fact that the stock value die 335 has three sides 368,370,372 with indicia representing a stock value increase and only two sides 380,382 with indicia representing a stock value decrease.

Returning to the path 16, there are three global risk spaces 406,408,410 disbursed among the stock spaces along the path. The first global risk space 406 is located between the transportation stock spaces 18 and 20 (see FIG. 2*a*). The second global risk space 408 is located between the basic materials stock space 78 and the utilities stock space 272 (see FIG. 2*b*). The third global risk space 410 is located between the financials stock space 142 and the healthcare stock space 166 (see FIGS. 2*c* and 2*d*). The global risk spaces 406,408,410 are identical in design, and it shall therefore be sufficient to describe just one of these spaces with the understanding that the other spaces are identical. With respect to the first global risk space 406, indicia 412 including the words "global risk cards" is provided within the space.

Associated with the global risk spaces 406,408,410 are a plurality of global risk cards 414 (see FIGS. 11*a* and 11*b*), one of which is drawn when a player lands on one of the global risk spaces. As shown in FIG. 11*b*, each of the global risk cards 414 includes indicia 416 that represents an increase or decrease in the value of at least one of the stocks. The indicia 416 shown in FIG. 11*b* is in the form of stock identification (e.g., "stock 2V"), an upwardly pointing arrow, and a value increase dollar amount of "9". This exemplary global risk card shown in FIG. 11*b* consequently represents a $9.00 per share increase for the stock represented by the third capital goods space 50.

There are preferably a total of sixty global risk cards 414. There are two cards for each of the eleven stock groups, with one of the cards representing a $5.00 per share increase in value and the other representing a $2.50 per share decrease in value. For example, there is a card representing a $5.00 per share increase in value of the transportation stock and another representing a $2.50 per share decrease in value of the transportation stock. The values for the stocks represented by both the transportation stock spaces 18 and 20 are both affected by each of these cards. For each of the stock spaces having an initial purchase price of $5.00 as shown in the drawings (i.e., stock spaces 18, 46, 78, 108, 142, 170, 198, 226 and 252), there is one corresponding global risk card representing a $3.00 per share increase in value and another global risk card representing $1.50 per share decrease in value. Of these spaces, the stock spaces 18 and 46 are identified on the same card, the spaces 78 and 108 are identified on the same card, the spaces 142 and 170 are identified on the same card, and the spaces 198,226 and 252 are identified on the same card. There are consequently a total of eight global risk cards identifying the stocks having an initial purchase price of $5.00. Two of the global risk cards, one representing a $6.00 per share increase in value and another representing a $3.00 per share decrease in value, are provided for each of the stock spaces having an initial purchase price of $10.00 (i.e., stock spaces 20, 48, 76, 106, 140, 168, 196, 224 and 250). Of these spaces, the stock spaces 20 and 48 are identified on the same card, the stock spaces 76 and 106 are identified on the same card, the stock spaces 140 and 168 are identified on the same card, and the stock spaces 196,224 and 250 are identified on the same card. There are consequently a total of eight global risk cards identifying the stocks having an initial purchase price of $10.00. For each of the stock spaces having an initial purchase price of $15.00 (i.e., stock spaces 50, 74, 104, 138, 166, 194 and 222), there is one corresponding global risk card representing a $9.00 per share increase in value and another global risk card representing a $4.50 per share decrease in value. Of these spaces, the stock space 50 is identified singly on one of the global risk cards, the stock spaces 74 and 104 are identified on the same card, the stock spaces 138 and 166 are identified on the same card, and the stock spaces 194 and 22 are identified on the same card. There are consequently a total of eight global risk cards identifying the stocks having an initial purchase price of $15.00. There is one global risk card representing an $18.00 per share increase in value and another representing a $9.00 decrease in value for each of the stock spaces having an initial purchase price of $20.00 (i.e., the stock spaces 270, 298, 272, 102, 300, 274 and 302). All of these spaces are identified on separate cards, such that there are a total of fourteen global risk cards identifying the stock spaces having an initial purchase price of $20.00.

Preferably, when one of the global risk cards 414 is drawn, it affects both the closing value and the purchase price of the stock. That is to say, any player who owns the stock identified on the drawn global risk card, must change the stock value accordingly. Additionally, the purchase price for the identified stock is changed the same amount. For example, with respect to the card shown in FIG. 11*b*, the purchase price for stock 2V (i.e., the stock represented by the capital goods space 50) is increased by $9.00 and all players owning shares of that stock receive an increase in value of $9.00 per share.

To help keep track of the current purchase price for a stock and to facilitate changing of the purchase price, a plurality of laminated disks 418 are provided (only one of the disks being shown in FIGS. 9*a* and 9*b*). Each disk 418 is preferably circular in shape and presents opposite faces 420 and 422. The face 420 includes indicia 424 in the form of a line and the symbol "$" (see FIG. 9*a*), and preferably one of the players erasably writes the current purchase price for the stock space oil the face 420. Because the purchase price of each of the stock spaces may vary, there are preferably at least as many disks 418 as stock spaces. The face 422 includes indicia 426 in the form of a line and the words "# of shares" (see FIG. 9*b*). In the preferred embodiment, only one thousand shares are available for each of the stock spaces, and the face 422 consequently permits the players to keep track of the number of shares available for that stock space. If desired, each disk 418 is placed on a corresponding one of the stock spaces while the game 10 is played. Additionally, a plurality of standard dry erase markers (not shown) may be provided to facilitate use of the disks 418.

The board 12 is provided with an undrawn global risk card space 426 and a drawn global risk card space 427 (see FIG. 2*b*). The spaces 426 and 427 are located inward of the basic materials group of stock spaces 74,76,78 and are positioned along a line that is generally parallel to that side of the path 16.

The path 16 is further defined by a start space 428 and a return to start space 430. The spaces 428 and 430 are located at opposite corners of the path 16, with the start space 428 being located between the transportation stock space 18 and the energy stock space 252 (see FIG. 2*a*) and the return to start space 430 being located between the consumer cyclicals space 108 and the financial space 138 (see FIG. 2*c*). The return to start space 430 is consequently midway along the path 16 relative to the start space 428. The players preferably begin at the start space 428, and this is preferably identified by indicia 432 such as the words "start your work week". The start space 428 preferably also includes monetary award indicia 434 in the form of the words "full week $400" and "half week $200". The return to start space 430 includes indicia 436 instructing a player who has moved to the space 430 to return to the start space 428. As shown in FIG. 2*c*, the indicia 436 is preferably in the form of words "go to start, ½ work=½ pay". As instructed by the indicia 434 of the start space 428, a player who makes it entirely around the path 16 will be awarded $400, while a player who makes it only halfway around the path 16 (i.e., a player who is returned to the start space 428 as a result of landing on the return to start space 430) will be awarded $200.

A confinement space 438 and a busted space 440 are located at the other opposite corners of the path 16. In this respect, the confinement space 438 is located between the capital goods stock space 50 and the basic materials stock space 74 (see FIG. 2*b*), and the busted space 440 is located between the healthcare stock space 170 and the technology stock space 194 (see FIG. 2*d*). The busted space 440 has indicia 442 representing a conviction for insider trading. The indicia 442 includes the words "insider trading", as shown in FIG. 2*d*, and further includes wording identifying first, second and third offenses. Preferably, the first offense involves a $500 penalty and two missed turns, a second offense involves a $1,000 penalty and three missed turns, and the third offense involves a $3,000 penalty and the end of the game for that player. The type of offense corresponds with the number of times that a player has moved to the busted space 440. For example, the second time a player lands on the busted space 440, that player will be required to relinquish $1,000 and skip three turns. It is also noted that a player who lands on the busted space 440 is relocated to the confinement space 438 and remains in the confinement space 438 during the missed turns. As shown in FIG. 2*b*, the confinement space 438 includes four game piece areas 444,446,448,450 to help track the number of turns lost by a player. The areas 444,446,448,450 include respective indicia in form of "spot 4", "spot 3", "spot 2" and "spot 1". Thus, a player required to skip two turns will initially move to area 448 and, after the first turn is skipped, to the area 450.

As shown in FIG. 2*a*, the path 16 further includes two spaces 452,454 each representing a monetary penalty for any player who moves to that space. The space 452 is located between the transportation stock space 20 and the utilities stock space 270, while the space 454 is located between the energy stock spaces 250 and 252. The space 452 has indicia 456 including the words "internal revenue service audit". Although not shown, the indicia 456 also includes various monetary penalties depending upon the total amount of cash (in the form of the bills 326) currently held by the player. The penalties are preferably as follows: $250 must be relinquished when the total cash in hand is less than $2,500; $500 must be relinquished when the total cash in hand exceeds $2,500 but is less than $5,000; $1,000 must be relinquished when the total cash in hand exceeds $5,000 but is less than $7,500; $2,000 must be relinquished when the total cash in hand exceeds $7,500 but is less than $10,000; and $3,500 must be relinquished when the total cash in hand exceeds $10,000. The space 454 has indicia in the form of the words "broker fees due" and the amount "$250". Accordingly, a player who moves or is moved to the space 454 is required to relinquish $250.

Finally, the path 16 includes three personal risk spaces 458,460,462 dispersed among the stock spaces along the path. The first personal risk space 458 is located between the capital goods stock spaces 46 and 48 (see FIG. 2*b*). The second personal risk space 460 is located between the consumer cyclicals stock spaces 102 and 104 (see FIG. 2*c*). The third personal risk space 462 is located between the consumer staples stock space 226 and the energy stock space 250 (see FIG. 2*a*). The personal risk spaces 458,460,462 are identical in design, and it shall therefore be sufficient to describe just one of these spaces with the understanding that the other spaces are identical. With respect to the first personal risk space 458, indicia 464 including the words "personal risk cards" is provided within the space.

Associated with the personal risk spaces 458,460,462 are a plurality of personal risk cards 466*a* (see FIGS. 10*a* and 10*b*) and 466*b* (see FIGS. 12*a* and 12*b*). A player who moves or is moved to one of the personal risk spaces 458,460,462 is required to draw one of the cards 466*a* shown in FIG. 10*a* and, if instructed to do so by that card, to also draw one of the cards 466*b* shown in FIG. 12*a*. As will subsequently be described, the cards 466*a* shown in FIG. 10*a* include indicia representing a monetary award or penalty or indicia representing no monetary impact to the player. For example, the card 466*a* shown in FIG. 10*b* includes monetary penalty indicia in the form of the words "car accident $1500 damage". When this card is drawn, the player must relinquish $1500 unless an insurance policy, as identified below, has been obtained. The top face of each of the cards 466*a* includes indicia 470 identifying the card as being one of the personal risk cards. As will also be subsequently be described, the cards 466*b* shown in FIG. 12*a* include indicia representing a monetary penalty and a number of turns to be skipped by the player. For example, the card 466*b* shown in FIG. 12*b* includes lost turn indicia 472 representing the number of turns to be skipped by the player and monetary penalty indicia 474 representing the amount of money to be relinquished by the player. The illustrated lost turn indicia 472 includes the numeral "1" thereby requiring the player to lose one turn, while the monetary penalty indicia 474 represents a $200 penalty for the first DWI offense, a $300 penalty for the second DWI offense, and a $1250 penalty for the third DWI offense. The top face of each of the cards 466*b* includes indicia 476 including the words "judgement day" so as to separate the cards 466*b* from the cards 466*a* shown in FIG. 10*a*.

A total of thirty-three cards 466*a* are preferably provided in the game 10. Of these cards 466*a*, ten include indicia (not shown) representing no monetary penalty or award for the player. This indicia is preferably in the form of the word "relax" and a design often referred to as a "smiley face". The preferred card set 466*a* further includes five cards including indicia (not shown) representing a monetary award to the player. The monetary award indicia is preferably in the form of the words "good night at the casino! $500", "state income tax return $200", "federal income tax return $500", "Christmas bonus $200", or "employee of the month $150". When a player draws one of these cards, he/she is awarded the amount indicated. There are preferably six of the cards 466*a* that include indicia representing a monetary penalty to the player (e.g., the indicia 468 shown in FIG. 10*b*). Beyond the monetary penalty indicia 468 shown in FIG. 10*b*, the monetary penalty indicia is preferably in the form of the words "car accident $1000", "car accident (liability) $1200", "bad night at the casino! $500", "state income tax (you owe) $200", or "federal income tax (you owe) $500". Nine of the cards 466*a* have indicia (not shown) representing various car insurance policies that may be purchased by the player to minimize the monetary penalty identified on the cards having car accident indicia (such as the card shown in FIG. 10*b*). A player is not required to purchase the insurance represented on the card; however, if the insurance is purchased, the player preferably retains the card in his/her possession until the insurance is used. The player must discard the insurance card once it is used and must again purchase one of the policies to obtain insurance coverage. It is also noted that several types of insurance policies are provided. Particularly, two of the cards 466*a* include indicia representing a $200 premium for a full coverage policy having a $250 deductible; three of the cards 466*a* include indicia representing a $100 premium for a full coverage policy having a $500 deductible; two of the cards 466*a* include indicia representing a $100 premium for a liability only policy having a $500 deductible; one of the cards 466*a* includes indicia representing a $150 premium for a liability only policy having a $250 deductible; and one of the cards 466*a* includes indicia representing a $300 premium for a full coverage policy having a $0 deductible. The premium is the amount the player pays for the insurance, and the insurance coverage lessens the monetary penalty represented by one of the car accident cards (such as that shown in FIG. 10*b*) the identified coverage amount minus the amount of any deductible. The liability policies may only be used to mitigate the monetary penalty of the card identifying a "liability" accident, while the full coverage policies may be used on any of the car accident cards. Finally, the card set 466*a* includes one card having indicia (not shown) representing a first driving while intoxicated ("DWI") offense, one card having indicia (not shown) representing a second DWI offense, and one card having indicia (not shown) representing a third DWI offense. Each of these cards requires the player to draw one of the judgement day cards 466*b* shown in FIG. 12*a*.

There are a total of thirteen judgement day cards 466*b*. Six of the cards 466*b* include the lost turn indicia 472 and monetary penalty indicia 474 shown in FIG. 12*b*. The remaining judgement day cards are similar to that shown in FIG. 12*b*, except for differences in the lost turn and monetary penalty indicia. Particularly, four of the remaining cards have lost turn indicia including the numeral "2" and monetary penalty indicia representing a $300 penalty for the first DWI offense, a $500 penalty for the second DWI offense, and a $1750 penalty for the third DWI offense. Two of the remaining judgement day cards have lost turn indicia including the numeral "3" and monetary penalty indicia representing a $400 penalty for the first DWI offense, a $750 penalty for the second DWI offense, and a $3000 penalty for the third DWI offense. The final judgement day card has lost turn indicia including the numeral "4" and monetary penalty indicia representing a $500 penalty for the first DWI offense, a $1000 penalty for the second DWI offense, and a $5000 penalty for the third DWI offense. A player, who is required to draw one of the judgement day cards 466*b* as a result of drawing one of the DWI cards of the personal risk card set 466*a*, must consequently lose the number of turns represented by the lost turn indicia. Preferably, the player will be required to move to the confinement space 438 and remain thereon until all of the turns have been skipped, as described above. Furthermore, the player will be required to relinquish the monetary penalty for the first, second, or third offense depending upon which of the DWI cards had been drawn. For example, if the player draws the DWI card representing a second DWI offense, the player must relinquish the monetary amount for the second DWI offense identified on the judgement card 466*b*.

Similar to the card spaces 426 and 427 for the global risk cards 414, the board 12 includes an undrawn personal risk card space 477 and a spaced drawn personal risk card space 478 spaced inwardly from the consumer staples and energy stock group identification areas 246 and 266 (see FIG. 2*a*). The personal risk cards 466*a* are normally located on the space 477 until they are drawn and discarded to the space 478. Located between the card spaces 477 and 478 is judgement day card space 479. The judgement day cards 466*b* may be placed on the card space 479. Because the judgement day cards 466*b* are preferably shuffled before a player draws one of the judgement day cards 466*b*, the board does not include a drawn judgement day card space.

Player movement along the path is represented by a plurality of game pieces 480 (see FIG. 7), with each of the pieces 480 representing one of the players. Although the illustrated game piece 480 has a generally standard construction, the principles of the present invention are equally applicable to various other game piece designs. For example, the game may alternatively be provided with a plurality of variously shaped game pieces, such as game pieces in the shape of a bull, a bear, a gavel, a bell, a dollar sign (e.g., "$"), a podium, a pocket watch having indicia indicating that the market is open, a pocket watch having indicia indicating that the market is closed, a "Wall Street" street sign, a tombstone having indicia representing the inception of the New York Stock Exchange, etc.

Figure 7:
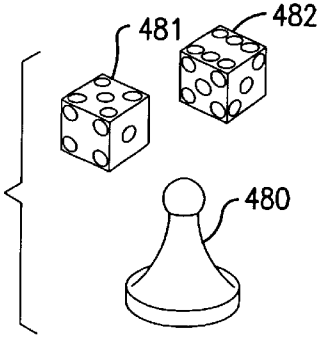
FIG. 7 is a perspective view of one of the game pieces used to represent a player and the six-sided dice for controlling movement of the game pieces along the path.

Player movement along the path is controlled by a pair of standard dice 481,482 (see FIG. 7). As is customary, the sides of each die 481 or 482 includes indicia in the form of spots numbering one to six. The game preferably involves having each player roll the dice 481,482 to determine the number of spaces that the player's game piece 480 is to be moved along the path 16. The principles of the present invention are equally applicable to various other devices for providing a random space count for player movement. For example, a numbered spinning wheel (such as that used in the board game sold under the designation "LIFE") may be used.

Figure 3:
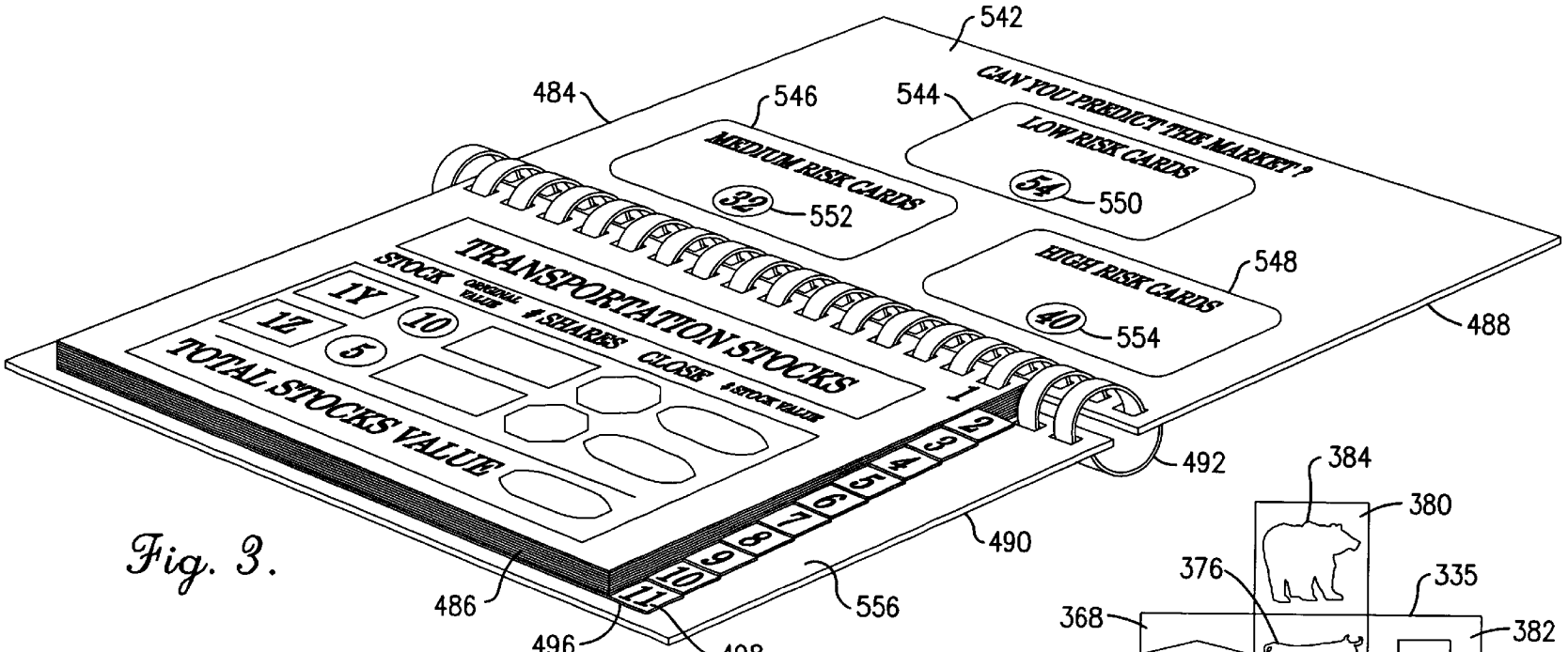
FIG. 3 is a perspective view of the stock portfolio booklet used for player input and storage of such information as the number of shares purchased of a stock and the closing value for the stock.

The game 10 further includes a plurality of stock portfolio booklets 484 (only one being shown in FIGS. 3 and 4), each of which serves as a log for one of the players to assist the player with, among other things, tracking of the number of shares purchased of a stock and the present closing value for the stock. The preferred booklet 484 comprises a plurality of laminated sheets 486 provided between top and bottom covers 488 and 490. In the illustrated embodiment, the sheets 486 and covers 488,490 are bound to one another by a so-called "GBC binding" element 492, although other suitable binding devices or arrangements may be used. The sheets 486 and covers 488,490 present numerous pages in which indicia is provided, as will subsequently be described. Each of the stock groups is represented on a separate one of the sheets 486, such that there are a total of eleven sheets.

Figure 4:
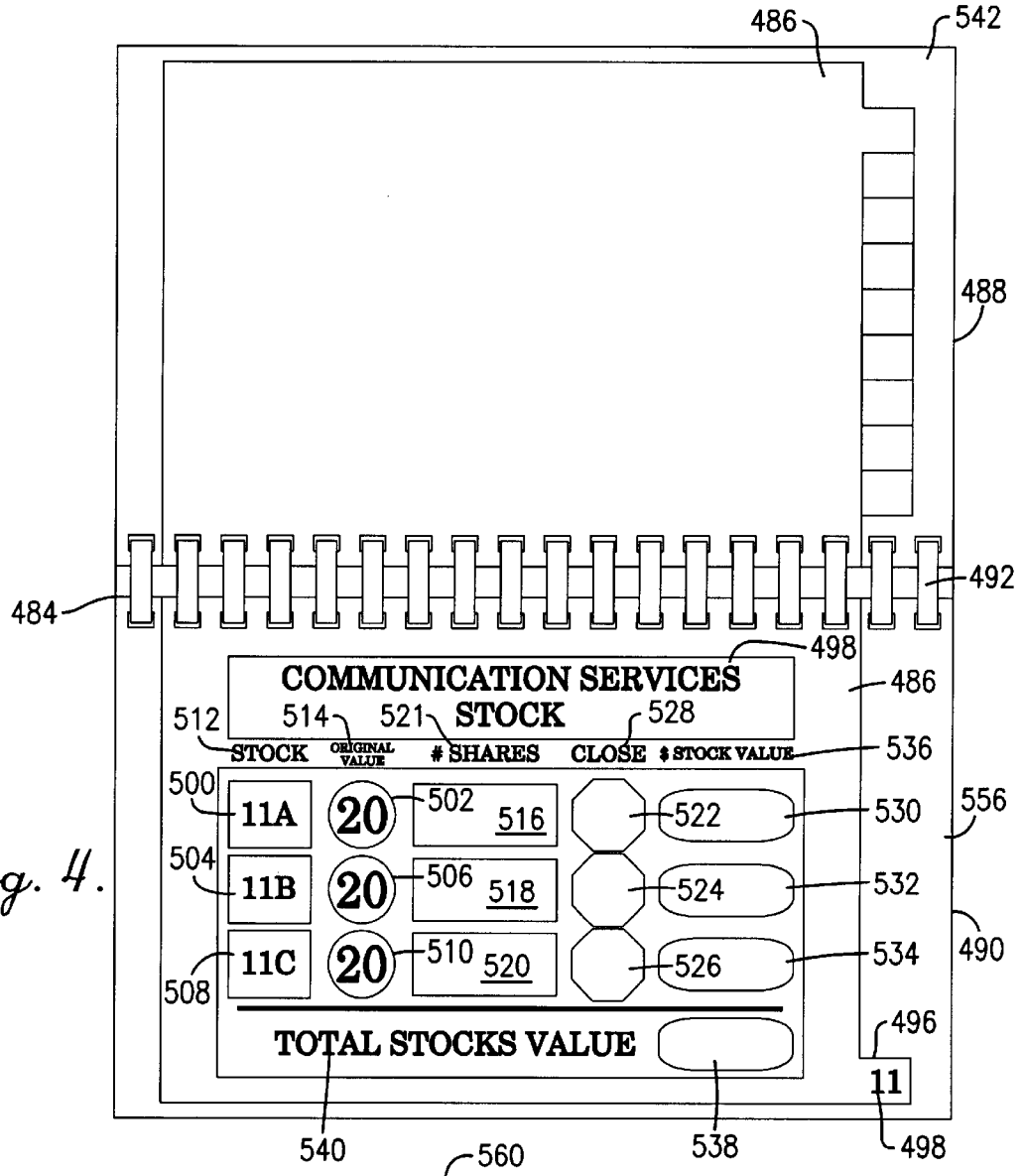
FIG. 4 is a top plan view of the stock portfolio booklet, but being opened to a different page than that shown in FIG. 3.
Figure 5:
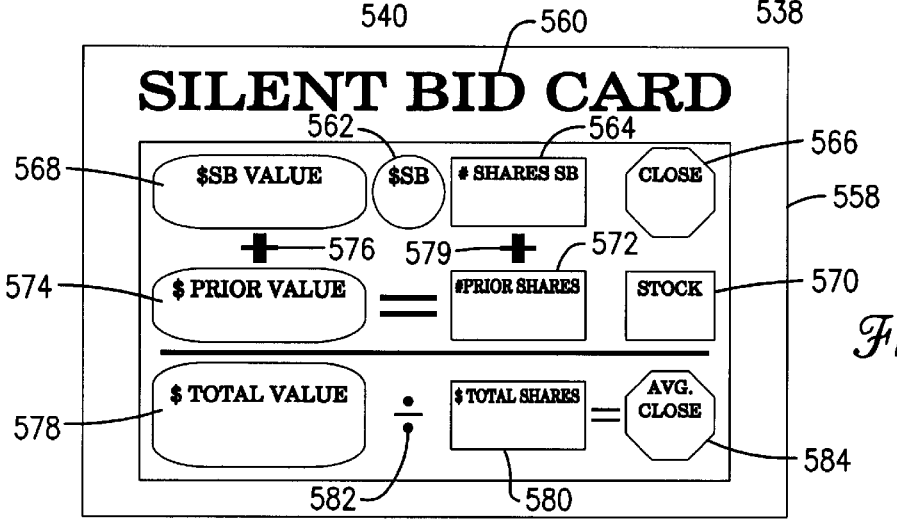
FIG. 5 is a top plan view of the silent bid card used by each player when bidding for stock that is being sold by one of the players.

As shown in FIG. 4, the communication services stock group is represented on the eleventh sheet, which corresponds with the group distinguishing indicia 310. This sheet not only includes indicia 494 in the form of the words "communication services stock" but also a laterally projecting tab 496 having indicia 498 in the form of the numeral "11". The page is provided with indicia 500 that is identical to the space identification indicia 312 for the first communication services stock space 298, as well as indicia 502 representing the initial purchase price for that stock space 298. The other two communication services stock spaces 300 and 302 are similarly identified by respective indicia 504,506 and 508,510. The indicia 500,504,508 identifying the three communication services stock spaces are positioned in a column below heading indica 512 in the form of the word "stock". Similar heading indicia 514 in the form of the word "original value" is similarly provided for the column of purchase price indicia 502,506,510. A column of shares purchased spaces 516,518,520 is provided under heading indicia 521 in the form of the words "#shares", and a column of closing value spaces 522,524,526 is provided under heading indicia 528 in the form of the word "close". The spaces 516,518,520,522,524,526 are blank and therefore permit the player to input the number of shares purchased and closing value of the stock represented by each of the spaces 298,300,302. Because the sheets 486 are preferably laminated, the player may erasably write information within the spaces 516,518,520,522,524,526. Again, the game 10 is provided with dry erase markers (not shown) for use with the portfolio booklet 484. Each of the communication services stock spaces is consequently represented along a horizontal row including the stock space identification indicia, the initial purchase price indicia, and player inputted information including the number of shares purchased and the present closing value per share. A column of stock value spaces 530,532,534 is provided under heading indicia 536 in the form of the words "$ stock value". The stock value spaces 530,532,534 permit the player to removably input the total dollar value for the shares purchased (the player preferably enters a value amount determined by multiplying the number of shares purchased and the closing value per share). A total value space 538 is provided below the stock value spaces 530,532,534 and alongside indicia 540 in the form of the words "total stocks value". The space 538 permits the player to enter the aggregate value of all owned communication services stock.

It will be appreciated that the sheets 486 for each of the other stock groups are arranged and constructed in essentially the same manner as that just described for the communication services stock group. Accordingly, these other sheets will not be described in detail. It is also noted that the inside face 542 of the top cover 488 includes a low risk card listing space 544, a medium risk card listing space 546, and a high risk listing space 548. The low risk card listing spaces 544 includes indicia 550 that is similar to the indicia 398 provided in the card listing space 396 of the board 12. The medium risk and high risk card listing spaces 546 and 548 are provided with similar card listing indicia 552 and 554, respectively. If desired, the inside face 556 of the bottom cover 490 is provided with a grand total space (not shown) in which the total value of the player's stock portfolio may be entered.

It will be appreciated that the principles of the present invention are equally applicable to various other devices capable of permitting input and storage of the stock purchased by the players and the closing value per share for those stocks. For example, a single log may be provided for all of the players. Alternatively, each player may be provided with a computerized portfolio device that stores inputted information and is capable of processing the information to automatically calculate total stock and stock group values and a grand total for the portfolio. It is noted that, with the preferred stock portfolio booklets 484, the game 10 is preferably provided with a calculator (not shown) to assist the players with calculating stock values and other calculations while playing the game.

In the preferred game method, players will be given the opportunity to purchase stock sold by one of the players. Such bidding is facilitated by a silent bid card 558 having indicia 560 identifying it as such. The card 558 is preferably laminated so that any writings on the card with one of the dry erase markers (not shown) are erasable. The card 558 is provided with a bid value space 562, in which the player enters the price he/she is willing to pay for the stock, and a shares bid space 564, in which the player enters the number of shares he/she wishes to purchase at the bid price. As will subsequently be indicated, it may be desirable to change the number written in the space 564 when the number of shares purchased by the bid is different than the number of shares for which the bid was made. Each of the bidding players is provided with one of the silent bid cards 558 and the game 10 consequently includes a plurality of the cards 558. As will subsequently be described, the closing value for stock purchased from another player may be different than the price paid for that stock. Accordingly, the bid card 558 includes a closing value space 566 in which the player may enter the closing value per share. The final value of the shares purchased from another player (i.e., the number of shares purchased multiplied by the closing value per share) is preferably entered in a silent bid value space 568. The card 558 is arranged to facilitate revaluation of a player's stock when the player purchases stock through a successful bid and already owns shares of that stock. Particularly, the card 558 includes a stock identification space 570 located below the closing value space 566. The alphanumeric identification for the stock (e.g., 1Z) is entered within the space 570. Below the shares bid space 564 is a prior shares owned space 572 in which the player enters the number of shares owned before the bid. A prior stock value space 574 is located below the silent bid value space 568. It will be appreciated that the player may simply transfer information from the stock portfolio booklet 484 to the spaces 572 and 574. Once the closing value per share for the stock purchased by a silent bid is determined, the total value of the purchased shares is entered in space 568 and this value may then be added to that entered in space 574, as represented by the symbol 576. A total stock value space 578 is provided so that the player may enter the result of this addition. The number of shares purchased by the bid (i.e., the number entered in space 564) is added to the number of shares previously owned (i.e., the number entered in space 572), as represented by symbol 579, and the aggregate amount may be entered in a total shares space 580. The closing value for all of the owned shares (the previously owned shares and the shares purchased by the silent bid) may simply be calculated by dividing the value in space 578 by the number in space 580, as represented by symbol 582. The card 558 includes an average closing value space 584 in which the closing value for all of the owned shares may be entered. Upon making the above-noted calculations, the information contained within the spaces 578,580,584 is transferred to the appropriate spaces within the portfolio booklet 484.

The method of playing the game 10 should be at least somewhat apparent from the foregoing description. Thus, it shall be sufficient to explain that the preferred game method begins with players' game pieces 480 being placed on the start space 428 and each player being given an initial amount of money (preferably $25,000). The players each take a turn rolling the die 481,482 and moving the number of spaces indicated thereby. Player movement along the path 16 is preferably in a clockwise direction, when viewing FIG. 1.

When a player moves to one of the stock spaces, the player is given the opportunity to purchase the stock represented by that space. The player is not required to purchase any stock; however, if stock is purchased, the player is preferably limited to purchasing the stock in increments of one hundred shares. To purchase stock, the player must relinquish an amount of money (preferably in the form of the faux bills 326) equal to the purchase price value of the stock. The purchase price value of the stock is determined simply by multiplying the present purchase price per share of the stock by the number of shares purchased. It is preferred that the player have enough faux bills 326 in hand to pay for the stock. That is to say, the preferred game method does not permit stock to be traded for stock. It is noted that any payment made by a player for stock or for monetary penalties is returned to a central depository in which unused faux bills 326 are stored. One of the players is preferably in charge of controlling money movement in and out of the depository.

Once a player has purchased stock, a closing value for the stock must be determined. In the illustrated embodiment, this is accomplished by having the player draw one of the stock value cards 330,332,334. Of course, the cards may alternatively be dealt to the player. In any case, the player is limited to selecting from the low, medium or high risk cards depending on the present value per share of the stock. As noted above, one of the high risk cards 330 may only be drawn when the value per share is at least $10, and one of the medium risk cards 332 may only be drawn when the value per share is at least $5. Because the preferred absolute minimum value per share for all the stocks is $0.25, one of the low risk cards 334 may always be drawn. It is again noted that the preferred game method requires the player to roll the stock value die 335 before one of the low risk cards 334 is drawn. Once a closing value is determined, the number of shares purchased and closing value for the stock is preferably entered in the player's portfolio booklet 484. It is noted that the closing value determined by the player does not affect the value of the same stock owned by other players. In this respect, several of the players may own shares of the same stock but have different closing values per share for that stock. Only when one of the global risk cards 414 is drawn does the closing value change for all of the players owning shares of the same stock, as will subsequently be described. It is also noted that, after the shares are purchased, the remaining number of available shares is written on the face 422 of one of the laminated disks 418 and this disk is placed on the stock space.

If the player moves to one of the stock spaces for which stock is already owned, the player is permitted to purchase additional shares (assuming all one thousand shares of the stock have not been purchased). The shares are purchased at the current purchase price and a closing value for only the newly purchased shares is determined. The average closing value per share is calculated from the values for the previously purchased shares and newly purchased shares and then entered in the portfolio book 484. In other words, the preferred game method does not require the player to determine a new closing value for previously purchased shares of stock when the player is purchasing additional shares of that stock. However, if the player moves to a stock space for which stock is already owned and the player decides not to purchase additional stock, the preferred game method requires the player to determine a new closing value for the previously purchased stock. The new closing value is determined by drawing one of the stock value cards 330, 332,334, as described hereinabove.

As noted above, the players are given an opportunity to keep track of which of the high, medium and low risk cards 330,332,334 have been dealt or drawn. Particularly, players can use the card listing spaces 544,546,548 provided in the portfolio booklet 484 or the listing spaces 344,358,396 provided on the board 12 to monitor which of the cards 330,332,334 have been drawn or dealt. The preferred game method permits the players to request that any one of the card sets 330,332,334 be reshuffled before that player's turn. Such reshuffling involves combining all of the drawn and undrawn cards and shuffling the combined stack of cards. For example, it may be prudent to make a request for reshuffling when a large proportion of the cards having stock increase indicia have already been drawn or dealt.

Each player is not required to roll the die 481,482 and move to another space during his/her turn. Instead, the preferred game method permits the player to alternatively sell stock during his/her turn. This permits the player to gain cash for purchasing additional stock. The player is permitted to sells shares in one hundred share increments of any one of the stocks owned by that player. The player is payed cash from the depository based on the present closing value for the stock in that player's portfolio. Moreover, the shares sold by the player are immediately available for purchase by any of the players (including the player who just sold the shares). The players are permitted to make bids for purchasing the stock in one hundred share increments using their respective silent bid cards 558. The bid made by each of the bidding players is not disclosed to the other players until all bids have been entered on the cards 558. Again, the bids must be at least as high as the absolute minimum value per share of $0.25. The player having the highest bid per share receives the number of shares he/she desires. If any of the sold shares remain, the next highest bidder receives the number of shares he/she desires. This continues until all bidding players receive the shares they desire or until all of the shares are purchased, whichever occurs first. Each successful bidding player pays for the stock with cash based on the bid value made by that player. Additionally, the closing value of the stock purchased by each of the bidding players is equal to the lowest successful bid value, regardless of what each of the bidding players payed for their stock. For example, if player A purchases one hundred shares of stock for $10 per share and player B purchases the remaining one hundred shares of stock for $5, the closing value for both players A and B is $5, notwithstanding the fact that player A paid $1000 for the stock and player B paid $500 for the stock. If any of the shares remain after the bidding transaction, these shares are added to the amount of available shares noted on the corresponding laminated disk 418.

If two of the players bid the same value amount for different numbers of shares, the player bidding for the greatest number of shares receives all of the desired shares and the other player receives any remaining shares. For example, if the players are bidding on four hundred shares of stock and player A bids $10 for three hundred shares and player B bids $10 for two hundred shares, player A purchases three hundred shares and player B purchases one hundred shares. If two of the players bid the same value amount for an equal number of shares and there are not enough shares for both players, the players will roll the dice 481,482 with the highest roll receiving the desired number of shares.

If one of the players moves to one of the global risk spaces 406,408,410, one of the global risk cards 414 must be drawn. As indicated previously, the drawn global risk card affects the closing value for all owned shares of the identified stock and also changes the purchase price for that stock. For example, if the global risk card 414 shown in FIG. 11*b* is drawn, any player owning shares represented by the stock space "2V" (i.e., stock space 50) must increase the closing value per share by $9. The purchase price for stock space 50 is also increased by $9, and the new purchase price is preferably written on the face 420 of the corresponding laminated disk. It is again noted that the closing value and the purchase price cannot be lowered by one of the global risk cards beyond the absolute minimum of $0.25 per share.

As noted above, there are a plurality of spaces on the board that affect only the player who moved to that space. For example, each player is monetarily awarded each time he/she passes the start space 428, with the award being relatively less when the player is returned to the start space 428 as a result of landing on the return to start space 430. The busted space 440 monetarily penalizes the player, causes the player to lose at least one turn, and relocates the player to the confinement space 438. In fact, the game will end for any player who lands on the busted space 440 a third time. The board also includes two spaces 452 and 454 that monetarily penalize only the player who lands on that space, as noted hereinabove. As also previously described, the personal risk spaces 458,460,462 and associated personal risk cards 466*a*,466*b* also have the potential of monetarily penalizing the player and causing the player to lose turns.

It is also noted that the preferred game method rewards a player who rolls a so-called "double" when rolling the dice 481,482. Particularly, a player receives an extra turn each time the rolled dice 481,482 represent the same value. For example, if a player rolls the dice 481,482 and both dice represent a value of four, the player will move eight spaces and, depending upon the space to which the player moves, sell or purchase stock, be monetarily penalized or awarded, etc. The player will then be given another turn, and this will continue as long as the player rolls doubles. Such an occurrence in the game method is preferably referred to as "on a roll". However, there are two instances when a player will not be rewarded an extra turn for rolling a double. First, if upon rolling a double the player moves to the busted space 440, the player will not receive an extra turn and will be required to lose the appropriate number of turns as described above. Alternatively, if the player lands on one of the personal risk spaces 458,460,462 and draws one of the personal risk cards 466*a* having DWI indicia such that one of the judgement day cards 466*b* must also be drawn, the player will not be rewarded an extra turn and will be required to skip the appropriate number of turns as described above.

The preferred game method involves having the players take turns until a predetermined amount of time has lapsed or until a predetermined monetary amount is exceeded by the combined money and stock value held by one of the players, whichever occurs first. For example, a suitable time limit is believed to be two hours, although no time limit is required. Instead, the end of the game may be defined only by a predetermined amount. For example, the game may be played until one of the players has a total portfolio value (i.e., the cash in hand added to the value of the owned stocks) in excess of $100,000.

The preferred game method is also applicable to computerized versions of the game 10. For example, the board may be displayed on a computer screen and random player movement may be provided by the computer, as well as dealing of the various cards 330,332,334,414,466*a*,466*b*. In fact all or some the cards may be eliminated with the computer being configured to randomly provide monetary penalties and awards, "global" changes to the closing values and purchase price of one of the stocks, etc. The computerized version of the game method would also automatically process stock values and other calculations for the players. A computerized version of the game method would permit remotely located players to play against one another using a computer network.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of playing an investment game, said method comprising the steps of:

(a) providing each player with an initial amount of money;

(b) having each player move along a game path that includes a plurality of stock spaces, each of which is associated with a stock and a purchase price for the stock;

(c) permitting each player to purchase the stock represented by one of the stock spaces when that player moves to said one of the stock spaces; and (d) determining a closing value for the stock purchased by the player, step (d) including the step of having the player select one of a plurality of risk levels, wherein the risk levels differ from one another by their respective ranges of possible changes in stock value.

2. A method as claimed in claim 1, step (d) including the step of using a chance indicator when the player purchases stock to determine the closing value of the stock.

3. A method as claimed in claim 2, step (d) including the step of having the player draw one of a plurality of stock value cards when the player purchases stock, with each of the stock value cards including value change indicia representing a change in stock value or no change indicia representing no change in stock value.

4. A method as claimed in claim 3, step (d) including the step of having the player select the stock value card from a low risk card set, a medium risk card set, or a high risk card set, with the high risk card set having cards with value change indicia that cooperatively identify a greater range of changes in stock value than the cards of the medium risk card set and the medium risk card set having cards with value change indicia that cooperatively identify a greater range of changes in stock value than the cards of the low risk card set.

5. A method as claimed in claim 4, step (d) including the step of limiting the player to selecting from one of the card sets based on a present value of the stock.

6. A method as claimed in claim 4, step (d) including the step of rolling a six-sided stock value die before one of the cards is drawn from the low risk card set, with the stock value die having three sides with indicia indicating that any value change indicia of the drawn card shall be considered an increase in stock value, two sides with indicia indicating that any value change indicia of the drawn card shall be considered a decrease in stock value, and one side with indicia indicating that there is no change in stock value and that one of the low risk cards consequently need not be drawn.

7. A method as claimed in claim 1, step (d) including the step of dealing to the player one of a plurality of stock value cards when the player purchases stock, with each of the stock value cards including value change indicia representing a change in stock value or no change indicia representing no change in stock value.

8. A method as claimed in claim 1, step (b) including the step of using a mechanism operable to provide a random space count to control player movement along the path.

9. A method as claimed in claim 8, step (b) including the step of rolling at least one six-sided die, with each of the sides including indicia representing a number.

10. A method as claimed in claim 1;

(e) providing a board that includes the plurality of stock spaces; and (f) providing a plurality of game pieces, with each of the pieces representing one of the players.

11. A method as claimed in claim 1; and (e) monetarily awarding or penalizing the player when the player moves to one of a plurality of personal risk spaces interspersed among the stock spaces along the path.

12. A method as claimed in claim 1; and (e) having the player draw one of a plurality of personal risk cards when the player moves to one of a plurality of personal risk spaces interspersed among the stock spaces along the path, with at least some of the personal risk cards including indicia representing a monetary award or penalty for the player.

13. A method as claimed in claim 1; and (e) permitting the player to sell stock for money during the player's turn.

14. A method as claimed in claim 13; and (f) permitting each player to bid on stock sold by one of the players.

15. A method as claimed in claim 14, step (f) including the step of each player using a bid card to make a bid for stock, wherein the bid card includes a bid value space and a shares bid space that cooperatively permit player entry of the price per share and number of shares for which the player's bid is made.

16. A method as claimed in claim 1; and (e) relocating the player to a confinement space located along the path when the player moves to a busted space spaced from the confinement space along the path.

17. A method as claimed in claim 16, step (e) including the step of making the player skip at least one turn when the player moves to the busted space.

18. A method as claimed in claim 17, step (e) including the step of making the player miss a progressive number of turns each time the player moves to the busted space.

19. A method as claimed in claim 1; and (e) returning the player to a start space located along the path when the player moves to a return to start space spaced from the start space along the path.

20. A method as claimed in claim 1; and (e) determining a new closing value for the stock purchased previously by the player when the player moves to the stock space associated with that stock.

21. A method as claimed in claim 1; and (e) changing the closing value of at least one stock when one of the players moves to one of a plurality of global risk spaces interspersed among the stock spaces along the path.

22. A method as claimed in claim 21, step (e) including the step of also changing the purchase price of said at least one stock an amount equal to the change in the closing value.

23. A method as claimed in claim 22, step (e) including the step of having the player draw one of a plurality of global risk cards when the player moves to the global risk space, with each of the global risk cards including indicia representing an increase or decrease in the purchase price and closing value for said at least one stock.

24. A method as claimed in claim 1; and (e) repeating steps (b) through (d) until a predetermined amount of time has lapsed or until a predetermined monetary amount is exceeded by the combined money and stock value held by one of the players, whichever occurs first.

25. A method as claimed in claim 1; and step (d) including the step of limiting the player's risk level selection depending on the purchase price of the stock.

* * * * *